US010252139B2

(12) United States Patent
Pierotti et al.

(10) Patent No.: US 10,252,139 B2
(45) Date of Patent: Apr. 9, 2019

(54) DELIVERY SYSTEM FOR TARGETED LAUNCHING OF SPORTS PROJECTILE

(71) Applicant: Monarc Inc., Tumwater, WA (US)

(72) Inventors: Nathan Pierotti, Dubuque, IA (US); Igor Karlicic, Iowa City, IA (US); Bhargav Maganti, Iowa City, IA (US)

(73) Assignee: MONARC INC., Seattle, WA (US)

( * ) Notice: Subject to any disclaimer, the term of this patent is extended or adjusted under 35 U.S.C. 154(b) by 0 days.

(21) Appl. No.: 15/604,457

(22) Filed: May 24, 2017

(65) Prior Publication Data

US 2017/0340943 A1 Nov. 30, 2017

Related U.S. Application Data

(60) Provisional application No. 62/340,961, filed on May 24, 2016.

(51) Int. Cl.
*F41B 4/00* (2006.01)
*A63B 69/40* (2006.01)
(Continued)

(52) U.S. Cl.
CPC ..... *A63B 69/406* (2013.01); *A63B 24/0021* (2013.01); *A63B 24/0087* (2013.01); *A63B 47/002* (2013.01); *A63B 69/00* (2013.01); *A63B 69/002* (2013.01); *A63B 71/0622* (2013.01); *A63B 71/0619* (2013.01); *A63B 2024/0025* (2013.01); *A63B 2071/025* (2013.01); *A63B 2071/0625* (2013.01); *A63B 2071/0655* (2013.01); *A63B 2071/0691* (2013.01); *A63B 2209/08* (2013.01); *A63B 2210/50* (2013.01); *A63B 2220/12* (2013.01); *A63B 2220/62* (2013.01); *A63B 2225/09* (2013.01);
(Continued)

(58) Field of Classification Search
CPC ..... A63B 69/40; A63B 69/406
See application file for complete search history.

(56) References Cited

U.S. PATENT DOCUMENTS 4,596,230 A 6/1986 Griffith
4,723,532 A 2/1988 Osojnak
(Continued)

OTHER PUBLICATIONS

PCT/US2017/034305 , "International Search Report and Written Opinion", dated Oct. 23, 2017, 17 pages.
(Continued)

*Primary Examiner* — John Ricci
(74) *Attorney, Agent, or Firm* — Kilpatrick Townsend & Stockton LLP

(57) ABSTRACT

A sports projectile delivery system may control the operation of a launcher to cause an American football or other sports projectile to be delivered to a target location on a field. In some aspects, the system can track player movements on the field, e.g., through the use of a tracking device mounted on the player, enabling the ball etc. to be launched to a player in anticipation of where the player will go. The system may include additional customization and/or logging options, e.g., permitting a player to designate a body position (e.g., above the head or near the knees) for delivery of the ball, designate a speed or hang time for delivery, or provide player data and analytics to an online or otherwise connected database.

20 Claims, 25 Drawing Sheets

(51) Int. Cl.

| | |
|---|---|
| ***A63B 69/00*** | (2006.01) |
| ***A63B 24/00*** | (2006.01) |
| ***A63B 47/00*** | (2006.01) |
| *A63B 71/06* | (2006.01) |
| *A63B 71/02* | (2006.01) |

(52) U.S. Cl.
CPC ..... *A63B 2225/30* (2013.01); *A63B 2225/50* (2013.01); *A63B 2243/007* (2013.01); *A63B 2243/0025* (2013.01); *F41B 4/00* (2013.01)

(56) References Cited

U.S. PATENT DOCUMENTS

| | | | | |
|---|---|---|---|---|
| 5,125,653 | A * | 6/1992 | Kovacs | A63B 69/406 |
| 5,464,208 | A * | 11/1995 | Pierce | A63B 69/406 |
| 6,082,350 | A * | 7/2000 | Crews et al. | A63B 69/406 |
| 6,807,959 | B1 | 10/2004 | Murdock et al. | |
| 7,610,909 | B2 * | 11/2009 | Greene | 124/78 |
| 8,287,404 | B2 * | 10/2012 | Cucjen et al. | 124/78 |
| 8,852,030 | B2 | 10/2014 | Campbell et al. | |
| 9,022,016 | B1 | 5/2015 | Hafer et al. | |
| 2002/0185120 | A1 * | 12/2002 | Scott | A63B 69/40 |
| 2013/0109510 | A1 | 5/2013 | Boehner | |
| 2014/0305420 | A1 | 10/2014 | Deese | |
| 2016/0263457 | A1 | 9/2016 | Campbell et al. | |
| 2016/0325168 | A1 | 11/2016 | Campbell et al. | |

OTHER PUBLICATIONS

PCT/US2017/034305 , "Invitation to Pay Additional Fees and Partial Search Report", dated Aug. 22, 2017, 12 pages.

* cited by examiner

DELIVERY SYSTEM FOR TARGETED LAUNCHING OF SPORTS PROJECTILE

CROSS-REFERENCES TO RELATED APPLICATIONS

This application claims the benefit of U.S. Provisional Application No. 62/340,961, filed May 24, 2016, the entire content of which is hereby incorporated in its entirety for all purposes.

FIELD OF INVENTION

The present disclosure relates generally to sports machinery and, more particularly (although not necessarily exclusively), to sports projectile launching machines or robotic ball throwing machines.

BACKGROUND

Training in most team sports often requires a minimum of two people, for example, a passer (e.g., a thrower or kicker) and a receiver. This often leads to many players not being able to practice to the extent they would like and therefore not achieving the level of proficiency they desire. Furthermore, the passer typically has to pass a high number of times to the receiver, which can be physically taxing and not frequently done to maintain the athlete's performance during games.

In many sports, including football, some inventions began to appear in the 1980's to help alleviate these issues. In particular, some machines were created to consistently throw balls to a set location. Another player would still have to feed balls into the machine, and set up the machine to fire to a certain location, with a certain speed and angle, but it was physically far less taxing to the player than to constantly throw the ball. This quickly became popular in training facilities.

Known devices for simulating throwing a football to an athlete are generally characterized by having to manually adjust the rotation of the throwing machine, adjust the angle at which the ball will be released, and adjusting the speed of the rotor wheels, which is proportional to the release velocity of the ball. The ball throwing devices heretofore require a user to approximate the position of the moving receiver, and time the release of the ball to deliver an accurate ball. This process presents many difficulties in receiving an accurate ball, setting the system up for use, and performing the task in a time-efficient manner.

BRIEF SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

Various embodiments herein relate to a sports projectile delivery system, such as for targeted delivery of American footballs (although the system alternatively may be optimized for use with other types of sports projectiles). The system can correspond to a machine that includes a launcher, a feeder, and a controller. The launcher includes components for launching a respective football. The feeder moves respective balls into position to be launched by the launcher. The controller controls components of the launcher and/or the feeder to cause the football to be launched with particular characteristics (such as speed and angle) to achieve a particular goal (such as to reach a particular location in a certain amount of time). In various aspects, the controller utilizes information from a tracking system to achieve the particular goal, such as delivering a football at a certain speed and height relative to a moving player. In some aspects, the controller may control the feeder and/or launcher without using a tracking system to achieve a particular goal, such as delivering a ball to a certain location on the field with a certain hang time, e.g., to simulate a specific type of punt.

For a fuller understanding of the nature and advantages of the present invention, reference should be made to the ensuing detailed description and accompanying drawings.

BRIEF DESCRIPTION OF THE DRAWINGS

Various embodiments in accordance with the present disclosure will be described with reference to the drawings, in which.

DETAILED DESCRIPTION

Figure 1:
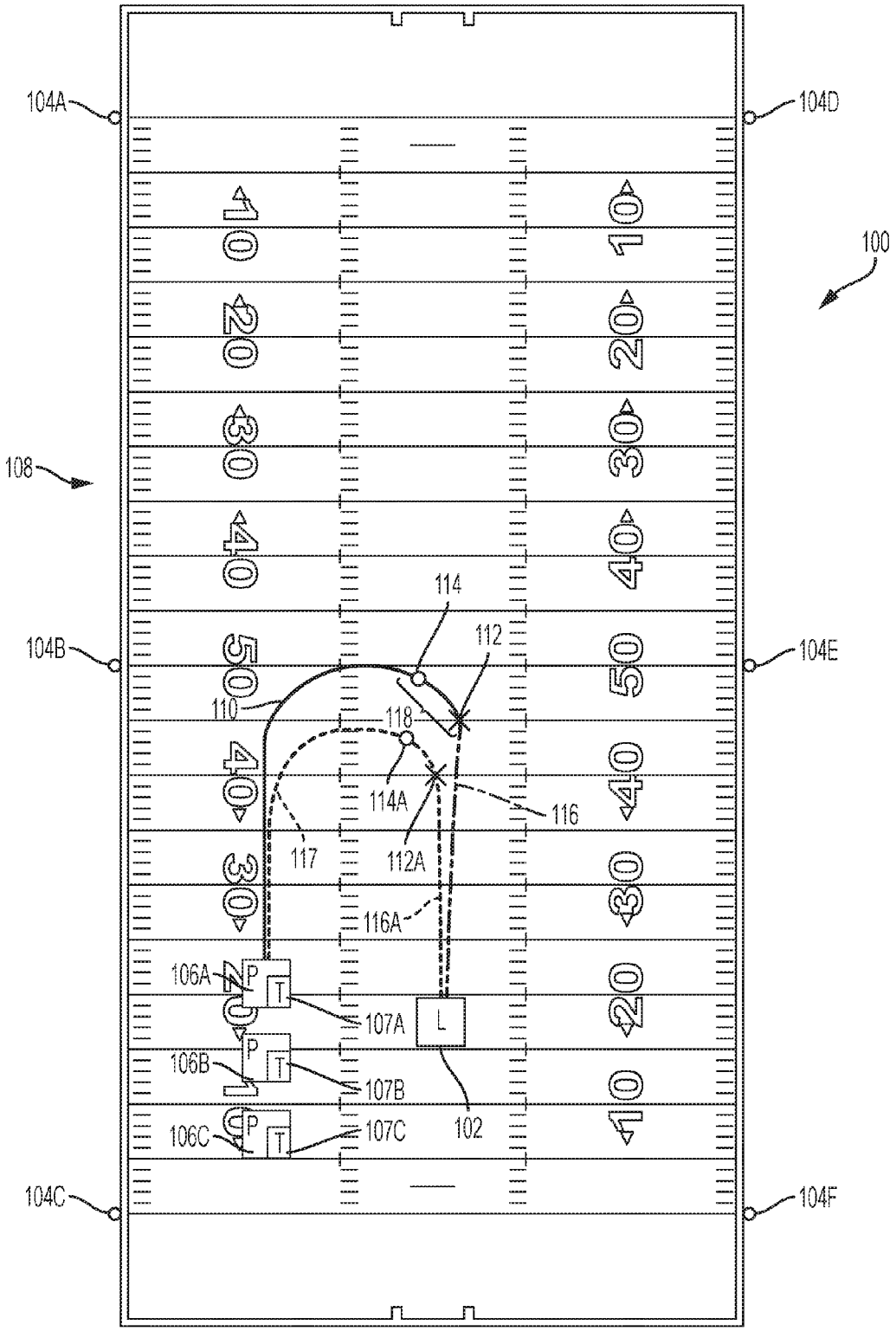
FIG. 1 is a top view of a field illustrating a sports projectile delivery system in operation according to various embodiments.

In the following description, various embodiments will be described. For purposes of explanation, specific configurations and details are set forth in order to provide a thorough understanding of the embodiments. However, it will also be apparent to one skilled in the art that the embodiments may be practiced without the specific details. Furthermore, well-known features may be omitted or simplified in order not to obscure the embodiment being described.

The specification and drawings are, accordingly, to be regarded in an illustrative rather than a restrictive sense. It will, however, be evident that various modifications and changes may be made thereunto without departing from the broader spirit and scope of the disclosure as set forth in the claims.

Disclosed herein are sports projectile delivery systems and various features and associated components thereof. Reference will now be made to the Figures, in which like reference numerals refer to like elements throughout the Figures. In many instances, similar elements may be identified by the same reference numeral and differentiated by a different letter suffix in the Figures. Thus in the following text description, elements may be referenced with suffixes (e.g., for referencing individual or specific elements such as a first player 106A or a second player 106B) or without suffixes (e.g., for generally or collectively referencing elements such as one or more of the players 106).

FIG. 1 shows an overhead view illustrating operation of an example of a sports projectile delivery system 100 according to certain embodiments. In FIG. 1, a launcher 102, anchors 104, and players 106 having tags 107 are shown positioned relative to a sports field 108.

In operation, a planned route 110 may be set for a first player 106A to follow to reach a target location 112 for catching a ball (or other form of sports projectile) from the launcher 102. As the first player 106A runs along the route, the position and progress of the player 106A may be tracked using a tag 107A clipped on or otherwise worn by the player 106A. An amount of time anticipated until the player 106A reaches the target location 112 (e.g., a "user time to target") may be calculated based at least in part on the tracked progression of the player 106A. Likewise, an amount of time anticipated between a firing signal for the launcher 102 and the launched ball arriving to the target location 112 (e.g., a "ball time to target") can be calculated based at least in part on settings for the launcher 102. Thus, the launcher 102 may receive a firing signal when the player 106A is detected as having reached a match point 114 along the route 110 at which the "user time to target" and the "ball time to target" match. As a result, the ball may travel from the launcher 102 to the target location 112 (e.g., along line 116) in the same amount of time that it will take for the player 106A to progress from the match point 114 to the target location 112 (e.g., along segment 118). This may present the ball and player 106A at the target location 112 at the same time for the player 106A to be able to make an attempt at catching, blocking, or otherwise interacting with the ball, for example, without the player 106A breaking stride.

The system 100 may permit multiple players 106 to utilize the same launcher 102 for separate or combined drills. For example, as shown in FIG. 1, players 106A, 106B, and 106C may line up and take turns running routes that may be tracked to enable the launcher 102 to deliver balls to whichever player 106 is taking a turn. Alternatively, the players 106 could each run routes simultaneously, in which case the launcher 102 might deliver balls at different times to different players 106 or deliver a ball to one of the tracked players 106 without the players 106 knowing ahead of time which one will receive the ball.

In another example, the second player 106B may deviate from the planned route 110, such as by starting to break across the field 108 earlier than in the planned route 110 (e.g., which may correspond to the player 106B following the actual route 117 shown in FIG. 1). This may prompt a new target location 112A, for example, from calculating where the actual route 117 is anticipated to go based at least in part on the tracked progress of the player 106B, an amount of deviation and/or consistency with the originally planned route 110, and/or a time limit for the actual route 117. The launcher 102 may fire when the player 106B reaches a revised match point 114A to deliver the ball (e.g., along line 116A) to where the player 106B will be, even though the player 106B may have followed an actual route 117 that differed from the planned route 110.

In other examples, the launcher 102 may operate without a planned route 110. For example, information from tracking a player 106 may be used to accurately place a ball for the player 106. For example, if a target location 112A is designated, the launcher 102 may delay launching until a tracked player 106B is identified as moving at a sufficient speed and direction to reach the target location 112A at the same time as the ball. As another example, the launcher 102 may be set to launch the ball after a certain duration of time. As the expiration of the time duration approaches, an expected location 112A of the player 106 may be calculated based at least in part on speed, direction, or other tracking information about the player 106, and the launcher 102 may be adjusted to launch the ball to arrive at that expected location 112A at the same time that the player 106B is expected to arrive. Such functionality may be useful, for example, for scramble drills or other scenarios where a pre-determined route 110 may not be designated.

Figure 2:
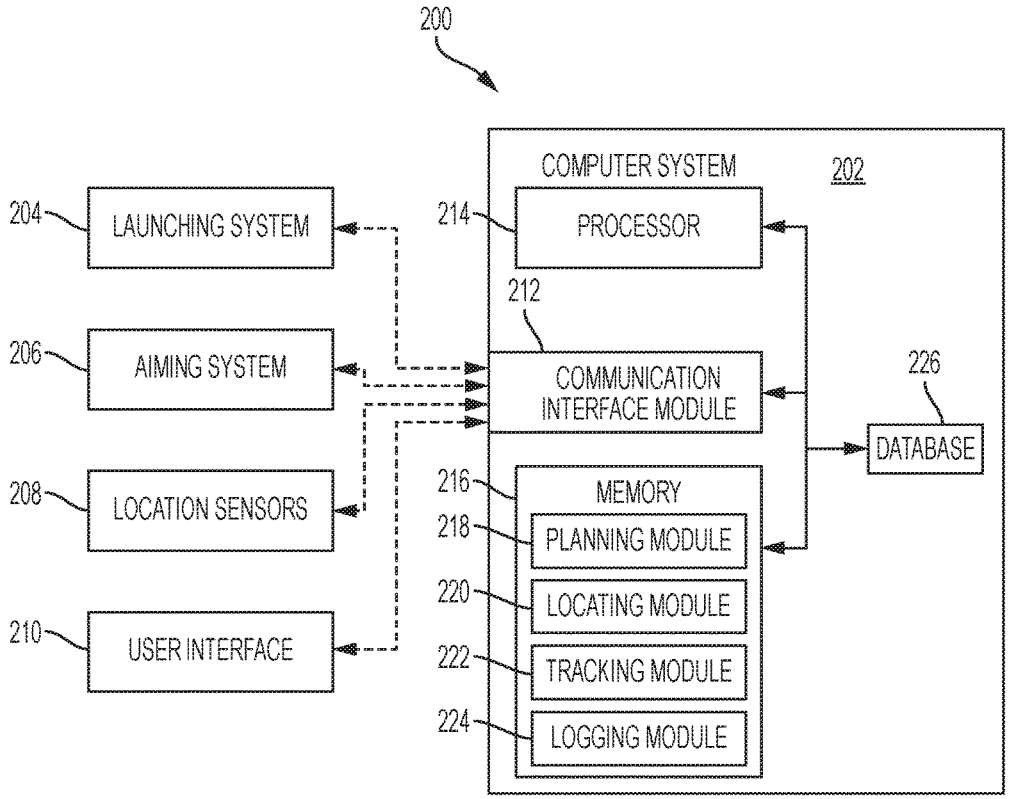
FIG. 2 is a schematic block diagram illustrating components of a sports projectile delivery system according to various embodiments.

Various components that may facilitate the functions described above (and/or others) are described in greater detail below beginning with the description of FIG. 2. FIG. 2 is a schematic block diagram illustrating components of a sports projectile delivery system 200, which may be an example of the sports projectile delivery system 100 shown in FIG. 1. The system 200 can include a variety of subsystems and/or sub-features that may be utilized individually or in combination. Although the system 200 will now be generally described for ease of reference as including all of the described features, the system 200 may include other combinations or sub-combinations of features that may include fewer or more than the features described herein.

As shown in FIG. 2, the sports projectile delivery system 200 includes a computer system 202, a launching system 204, an aiming system 206, location sensors 208, and a user interface 210. In general, the computer system 202 may function as a controller that controls other components of the sports projectile delivery system 200, for example, as described further below. Moreover, the launching system 204, the aiming system 206, the location sensors 208, and the user interface 210 may function as appropriate inputs and/or outputs for control of the sports projectile delivery system 200 by the computer system 202.

The launching system 204 may be an example of the launcher 102 described with reference to FIG. 1. The launching system 204 (which may alternatively be referred to herein as a launcher 204) includes components for imparting motion to sports projectiles. For example, in various embodiments herein, the launcher 204 includes a set of rotors for launching an American football (hereinafter football). The rotors may be rotated such that a football introduced between the rotors will be pulled forward by the rotation of the rotors and launched out of the front of the rotors. The rotors may be aligned with one another in different arrangements to cause the football to be launched with different characteristics, e.g., mimicking throwing (or in some cases a more specific type of throwing such as left-handed throwing or right-handed throwing), kicking (or in some cases a more specific type of punting such as left-footed punting or right-footed punting), or snapping (or in some cases a more specific type of snapping such as a shotgun snap or a long snap for punting).

For the sake of simplicity, examples herein will mainly refer to rotors for launching a football; however, the launcher 204 is not so limited. Rather, the launcher 204 may be customized for use with any suitable sports projectile, including, but not limited to footballs, soccer balls, rugby balls, baseballs, softballs, lacrosse balls, tennis balls, table tennis balls, water polo balls, hockey pucks, field hockey balls, volleyballs, basketballs, jai alai balls, racquet balls, squash balls, cricket balls, flying discs, medicine balls, dodgeballs, golf balls, or whiffle balls. Moreover, the launcher 204 is not limited merely to rotors, but may additionally or alternatively include any suitable motion-imparting components, which may include, but are not limited to, rotating arms, translating arms, cannons, slingshots, ballistas, catapults, trebuchets, or any other mechanically-, electrically-, magnetically-, and/or chemically-driven launcher 204.

The aiming system 206 includes components for arranging, re-orienting, or otherwise controlling elements of the launcher 204 to cause the launcher 204 to launch the sports projectile to a particular location. For example, in various embodiments herein, the aiming system 206 includes a "yaw" positioning motor capable of rotating the rotor assembly of the launcher 204 about a yaw axis (e.g., for adjusting leftward or rightward), a "pitch" positioning motor capable of rotating the rotor assembly of the launcher 204 about a pitch axis (e.g., for adjusting upward or downward), and a speed control capable of varying a speed of the rotors (e.g., for adjusting an initial velocity imparted to the football). The components of the aiming system 206 can be controlled in combination to change an initial vector (e.g., direction and speed) at which the football is launched, which may determine a resulting location that the football will reach and/or particular characteristics (such as speed or orientation) of the football when reaching that resulting location. However, the aiming system 206 is not limited to motors that control rotation of respective components, but may additionally or alternatively include sliding rails, adjustable springs, adjustable dampers, or any other any other components capable of adjusting relative placement and/or magnitude of components of the launcher 204.

The location sensors 208 include components for providing information about a location of the launcher 204 and/or other components relative to other points of interest. For example, the location sensors 208 may provide information about a location of the launcher 204 relative to points on a field of play and/or relative to targets (such as moving players 106). The location sensors 208 can be distributed among any suitable location or structure, including structures associated with the launcher 204, with tags 107 to be worn by players 106, and/or anchors 104 to be located on the field. The location sensors 208 can use any infrastructure for providing location reference points. For example, the anchors 104 and player tags 107 may be located by use of an Ultra Wide Band ("UWB") localization system; however, the location sensors 208 may additionally or alternatively utilize GPS tracking, triangulation, or other locating techniques or technologies. In operation, a UWB may advantageously provide the ability to receive input from a wide range of anchors 104 (e.g., between 3 and 12) and may permit a wide variety of calibration options by selecting among different UWB channels, bitrates, pulse repetition frequencies, and preamble lengths.

The user interface 210 includes components for facilitating information transfer from a user to the computer system 202 and/or from the computer system 202 to a user, e.g., regarding operation of the sports projectile delivery system 200. For example, the user interface 210 may include an input device through which a user can indicate a place on a field to which a ball is to be delivered. As another example, the user interface 210 may allow the user to specify where relative to a player's body the ball is to be delivered. As a further example, the user interface 210 may allow the user to specify characteristics of the ball, such as a speed at which the ball is to be travelling when arriving to its target destination, an amount of time a ball is to be in the air before arriving to its target destination, whether a ball is to mimic a throw or a kick or other movement pattern, etc.

The user interface 210 can correspond to any single component or combination of components. In one example, the user interface 210 includes a touch screen and joystick that are physically joined with the launcher 204, while another portion of the user interface 210 corresponds to buttons or other input devices positioned on tags 107 worn by players 106 that are physically separate from the launcher 204. However, the user interface 210 is not limited to this example, and may include components at least partially physically attached with or at least partially detached from the launcher 204 or any other component of the system 200.

The user interface 210 can additionally or alternatively include components for alerting users as to operation of the sports projectile delivery system 200. For example, the user interface 210 may include a monitor that displays information about settings of the launcher 204 or other components of the system 200. In some examples, the user interface 210 may provide visual, audio, or tactile alerts that operations have started or stopped. For example, a speaker, light, and/or vibrating panel may alert a player 106 that it is time to begin running a route.

The illustrated computer system 202 includes a communication interface module 212, a processor 214, a memory 216, a planning module 218, a locating module 220, a tracking module 222, a logging module 224, and a database 226. The computer system 202 may represent a single component, multiple components located at a central location within the sports projectile delivery system 200, or multiple components distributed throughout the sports projectile delivery system 200. In general, the computer system 202 may include any appropriate combination of hardware and/or software suitable to provide the described functionality.

The processor 214 is operable to execute instructions associated with the functionality provided by the computer system 202. The processor 214 may comprise one or more general purpose computers, dedicated microprocessors, or other processing devices capable of communicating electronic information. Examples of the processor 214 include one or more application-specific integrated circuits (ASICs), field programmable gate arrays (FPGAs), digital signal processors (DSPs) and any other suitable specific or general purpose processors.

The memory 216 stores processor instructions, state information for the various components of the sports projectile delivery system 200 and/or any other appropriate values, parameters, or information utilized by the computer system 202 during operation. The memory 216 may represent any collection and arrangement of volatile or nonvolatile, local or remote devices suitable for storing data. Examples of the memory 216 include, but are not limited to, random access memory (RAM) devices, read only memory (ROM) devices, magnetic storage devices, optical storage devices or any other suitable data storage devices.

The communication interface module 212 facilitates communication between the computer system 202 and other components of the sports projectile delivery system 200, including information and/or instructions conveyed between any of the launching system 204, the aiming system 206, the location sensors 208, the user interface 210, the planning module 218, the locating module 220, the tracking module 222, and the logging module 224, and the database 226. These communications may represent communication of any form appropriate based at least in part on the capabilities of the computer system 202 and may include any suitable information. Depending on the configuration of the computer system 202, the communication interface module 212 may be responsible for facilitating either or both of wired and wireless communication between the computer system 202 and the various components of the sports projectile delivery system 200. In particular embodiments, the computer system 202 may communicate using communication protocols such as 802.11, Bluetooth, or Infrared Data Association (IrDA) standards.

In general, the planning module 218, the locating module 220, the tracking module 222, the logging module 224, the database 226, and the communication interface module 212 may each represent any appropriate hardware and/or software suitable to provide the described functionality. In addition, as noted above, the computer system 202 may, in particular embodiments, represent multiple different discrete components and any or all of the planning module 218, the locating module 220, the tracking module 222, the logging module 224, the database 226, and the communication interface module 212 may represent components physically separate from the remaining elements of the computer system 202. Moreover, any two or more of the planning module 218, the locating module 220, the tracking module 222, the logging module 224, the database 226, and the communication interface module 212 may share common components. For example, in particular embodiments, the planning module 218, the locating module 220, the tracking module 222, the logging module 224, and the database 226 represent computer processes executing on the processor 214, and the communication interface module 212 comprises a wireless transmitter, a wireless receiver, and a related computer process executing on processor 214.

The planning module 218 includes components for controlling the aiming system 206 and the launching system 204 to cause the launcher 204 to deliver the football (or other sports projectile) to a particular location at a particular time. For example, the planning module 218 may utilize suitable computer processes to determine an amount of time that the football will take to move from the launcher 204 to a particular location aimed at by the aiming system 206 and cause the launcher 204 to fire at a corresponding time to cause the football to arrive to the particular location at a certain time. For example, the planning module 218 may receive input about a route to be run by a player 106 and control the aiming system 206 and the launching system 204 to cause the football to arrive to a location at the specific point in time that the player 106 is anticipated to arrive at the same location (e.g., the target location 112 of FIG. 1).

The locating module 220 can determine the location of components of the sports projectile delivery system 200 relative to a common frame of reference (e.g., the field 108) and/or relative to one another. For example, the locating module 220 may receive input from the location sensors 208 to determine such relative locations. In one example, a pair of anchors 104 are positioned on opposite ends of the mid-field line, and the locating module 220 uses signals conveyed between the launcher 204 and each of the anchors to determine relative distances to the anchors 104, which may provide sufficient information for triangulating a position of the launcher 204 relative to the anchors 104 and thus relative to the field 108. Similarly, a tag 107 of a player 106 may include a location sensor 208 that can provide information that can be used by the locating module 220 to determine a position of the player relative to the field 108 or other reference point.

The tracking module 222 includes components for tracking the position of a player. For example, the tracking module 222 may obtain information from the location sensors 208 (e.g., as processed by the locating module 220) to provide information about the position of the player relative to the launcher 204. The position of the player may be utilized as input to the planning module 218. For example, the planning module 218 may update and/or otherwise alter a target location and/or delivery time of a football based at least in part on the position of the player provided by the tracking module 222.

The logging module 224 includes components for logging activity of players and/or the sports projectile delivery system 200. For example, information from the tracking module 222 may be recorded and aggregated to provide historic information about player performance, e.g., which may be stored in the database 226 for later access and review by users and/or the sports projectile delivery system 200. For example, the communication interface module 212 may convey information from the logging module 224 to the database 226 or other point of access for the players 106 or coaches.

The database 226 can include a store of information that can be accessed and/or updated by the sports projectile delivery system 200. In some examples, information from the database 226 may be utilized to tailor operation of the system 200. For example, the database 226 may include player profiles with overall height, arm length, torso length, leg length, or other metrics that may be useful for determining an appropriate location to target in order to deliver the ball at a particular position relative to the player, such as below the player's knees, above the player's waist, etc.

Features of the sports projectile delivery system 200 may be incorporated into various respective components. One example of a device that may incorporate features of the system 200 is shown in FIG. 3.

Figure 3:
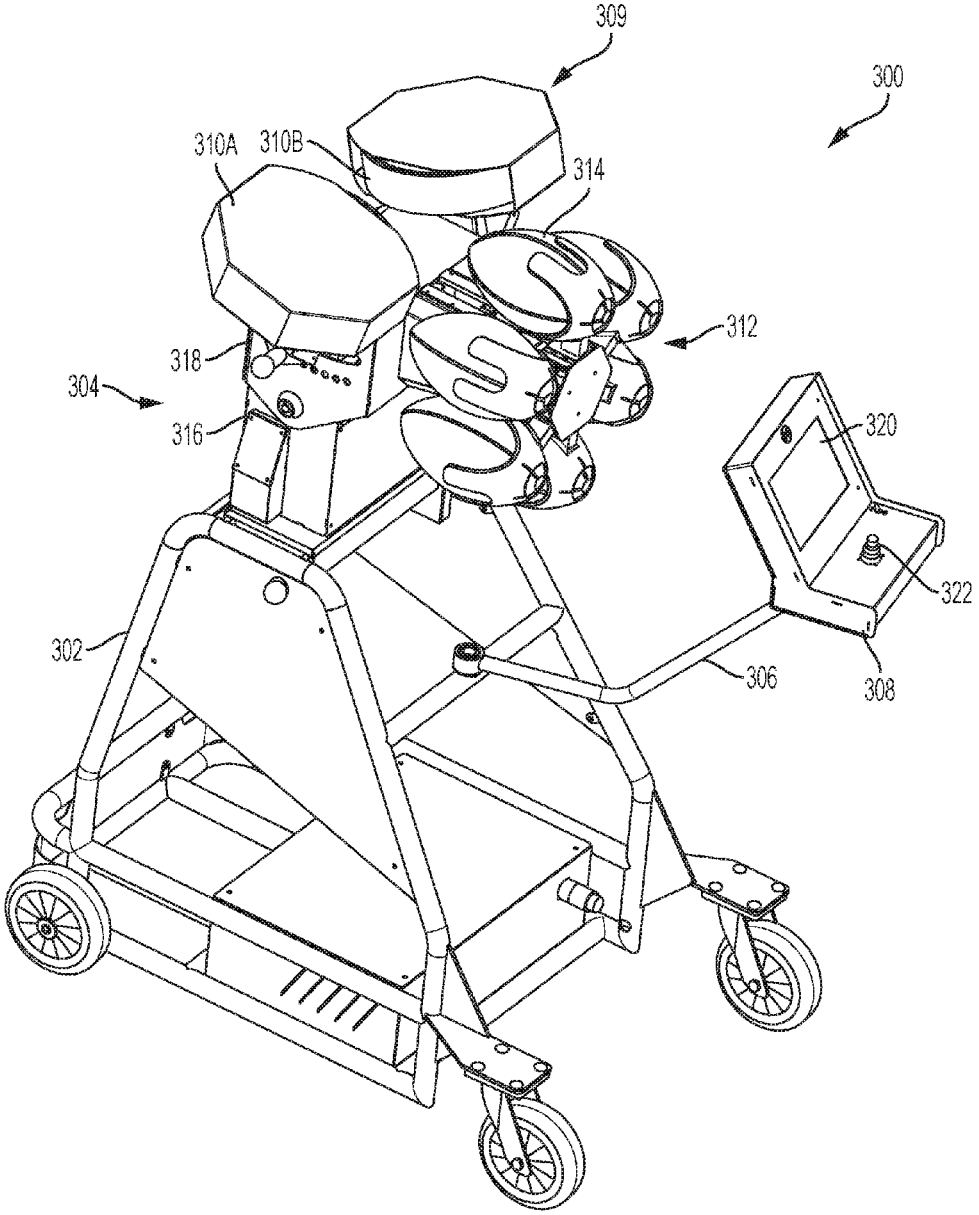
FIG. 3 is a top perspective view of a machine that incorporates various aspects of a sports projectile delivery system according to various embodiments.

FIG. 3 shows a top perspective view of a machine 300 that incorporates various aspects of the sports projectile delivery system 200. The machine 300 shown in FIG. 3 includes a base 302, a tower 304, a control arm 306, a control panel 308, a launcher 309, and a feeder 312. The tower 304 is supported by the base 302 and supports the launcher 309 and the feeder 312. The feeder 312 can be actuated to supply a football 314 to the launcher 309. The depicted launcher 309 includes rotors 310. Rotation of the rotors 310 can impart motion to the football 314 from contact between the football 314 and rotors 310 and cause the football 314 to be launched from the machine 300. The launcher 309 and feeder 312 may correspond to components of the launching system 204 described above with reference to FIG. 2.

The tower 304 also includes a first joint 316 and a second joint 318 that may be adjusted individually or collectively to adjust a position and/or orientation of the rotors 310 and/or other elements of the launcher 309 relative to the base 302. Such adjustment may vary the flight of the launched football 314 and the placement of the location to which the football 314 is delivered by the launcher 309. The first joint 316 and the second joint 318 may correspond to components of the aiming system described above with reference to FIG. 2.

The control panel 308 may provide an interface through which a user can provide input for the machine 300. For example, the first joint 316 and the second joint 318 may be adjusted based at least in part on input received through the control panel 308 or other user interface. The control panel 308 is shown with a display 320 (e.g., a touchscreen) and a joystick 322, but may include additional or alternative input devices. The control panel 308 may correspond to components of the user interface 210 described above with reference to FIG. 2.

The machine 300 may be collapsible. Being collapsible may facilitate storage or transport of the machine 300 when not in use. In one example, the machine 300 may collapse from a full height of approximately 6 feet (1.8 meters) to a collapsed height of approximately 32 inches (0.8 meters), e.g., which may allow the machine 300 to fit within the height clearance of a typical sports utility vehicle cargo space for transport between different fields of use.

Figure 4:
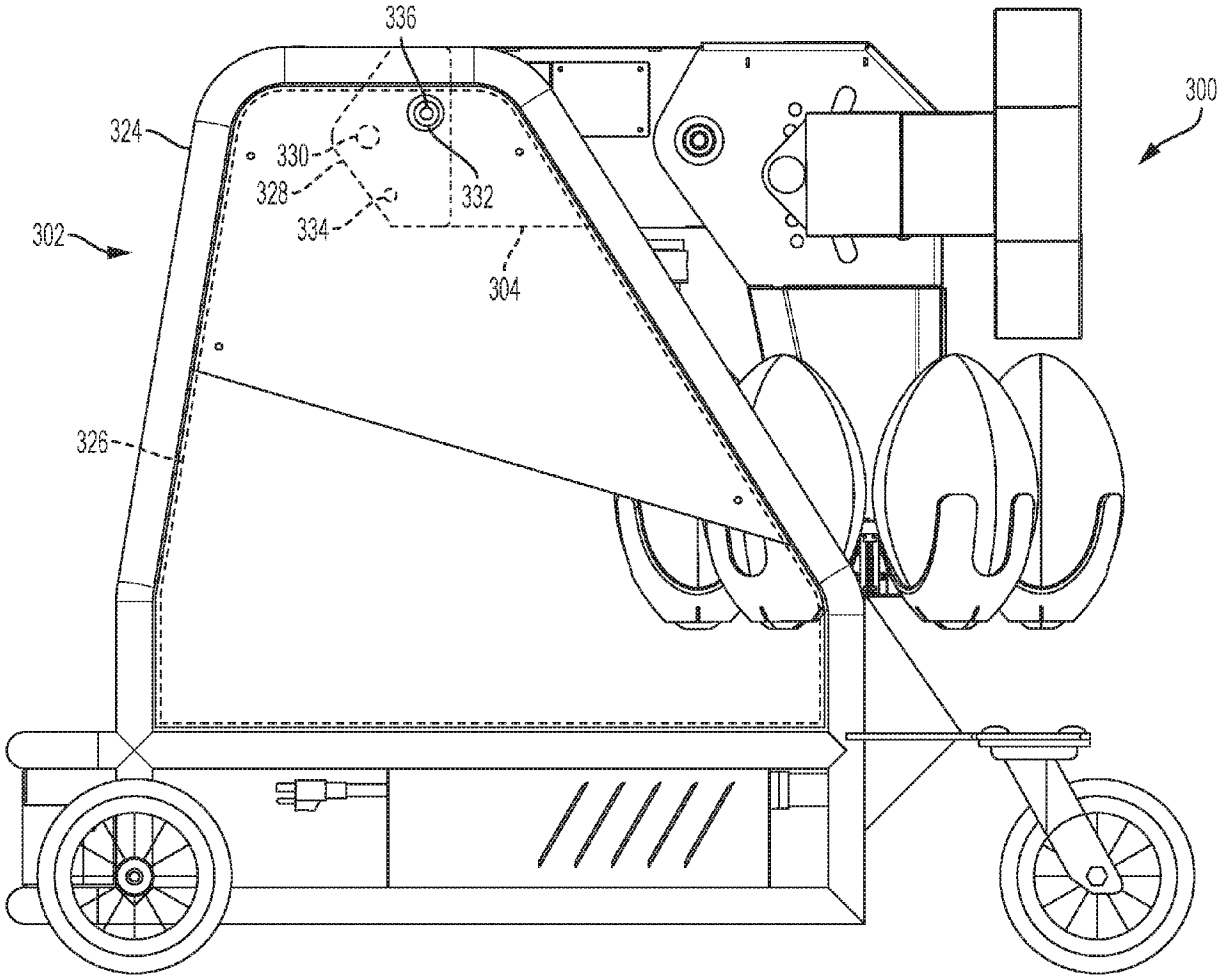
FIG. 4 is a side view showing the machine of FIG. 3 in a collapsed or stowed position according to various embodiments.
Figure 5:
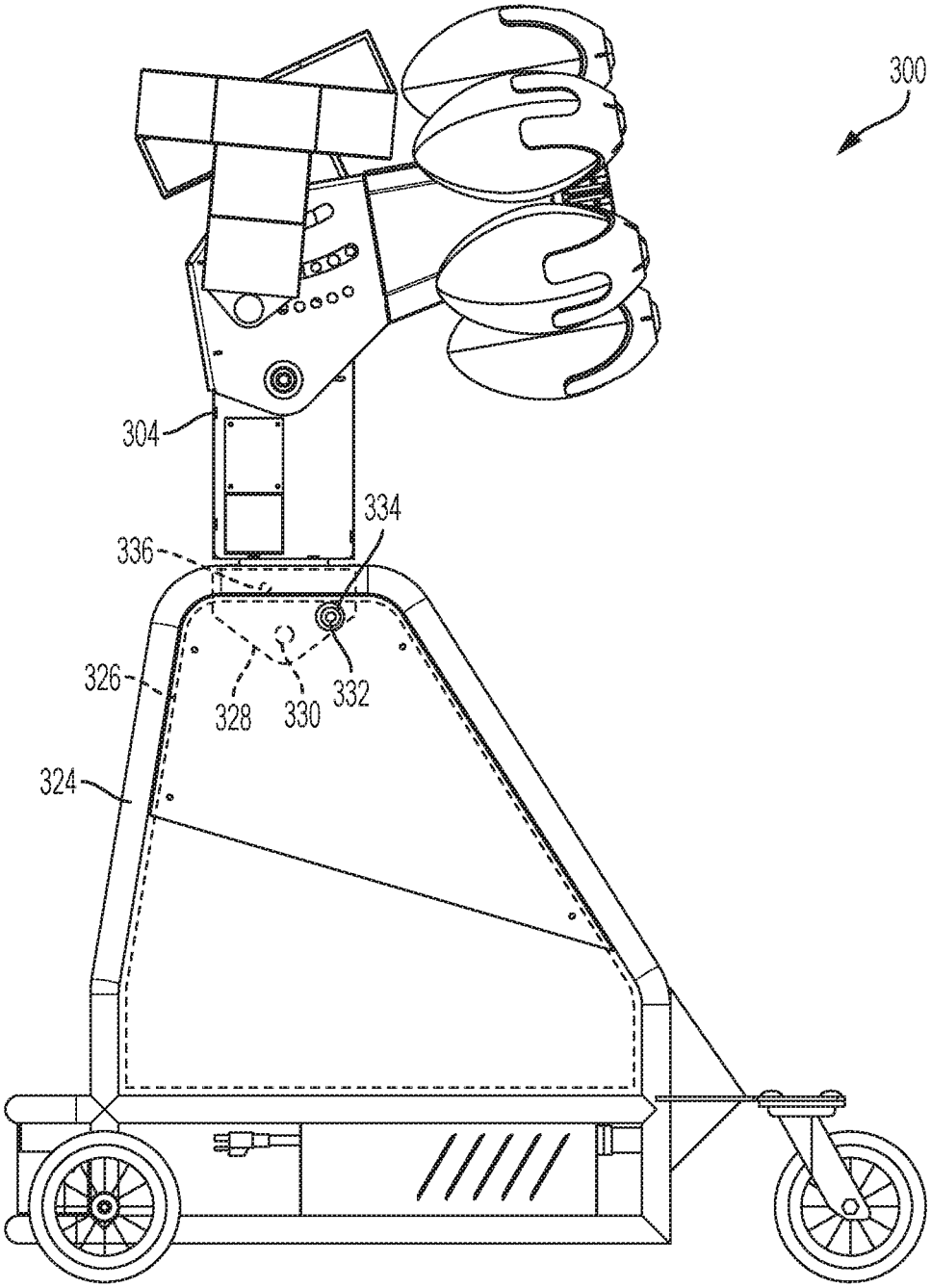
FIG. 5 is a side view showing the machine in an upright or deployed position.

FIG. 4 is a side view showing the machine 300 in a collapsed or stowed position, and FIG. 5 is a side view showing the machine 300 in an upright or deployed position. As shown in both FIGS. 4 and 5, the base 302 includes a frame 324 that at least partially bounds an interior volume 326. In the stowed state position in FIG. 4, the tower 304 is at least partially within the interior volume 326. In the deployed position shown in FIG. 5, the tower 304 is at least partially out of the interior volume 326. The tower 304 may be pivotally coupled with the base 302 by a pivot joint 328 so as to be pivotable about the pivot joint 328 between the stowed position (FIG. 4) and the deployed position (FIG. 5). For example, the pivot joint 328 may include a first opening 330 that receives a bar to permit pivoting.

A lock 332 may alternatively secure the tower 304 in the stowed position (FIG. 4) or the deployed position (FIG. 5). For example, the lock 332 is depicted as a post that can be engaged in either a deployed locking opening 334 or a stowed locking opening 336. A knob on the post may facilitate gripping by a user for retraction of the post from a respective opening 334 or 336 to allow pivoting of the tower 304. The post may be spring-loaded or otherwise biased to allow the lock 332 to snap into locking engagement when a respective opening 334 or 336 is brought into alignment with the post during rotation about the pivot joint 328.

Figure 6:
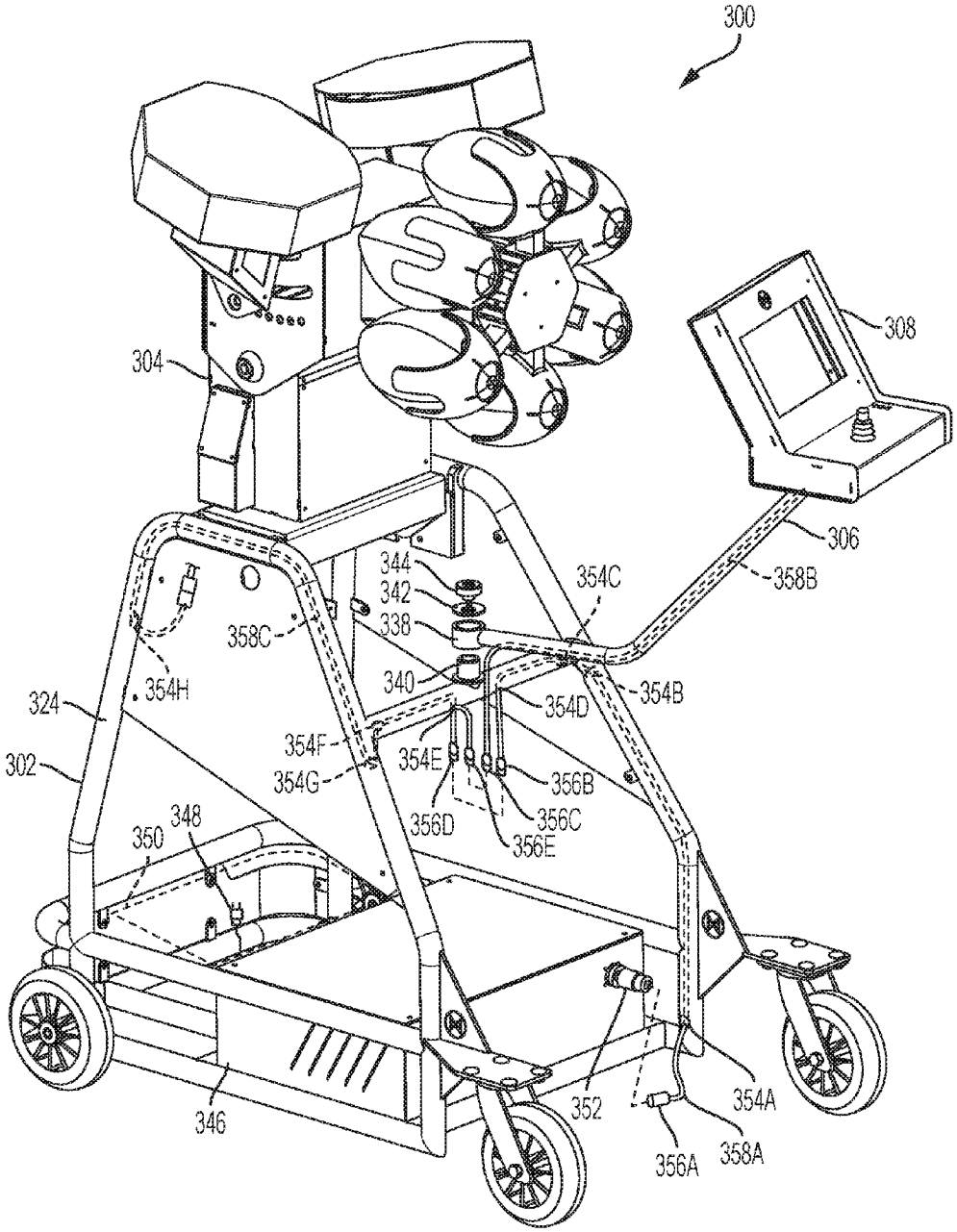
FIG. 6 is a top perspective view of the machine with a control arm aligned for installation.

Referring to FIG. 6, when setting up the machine 300 for use, the control arm 306 may be installed after deploying the tower 304 relative to the base 302. For example, in FIG. 6, a pivoting end 338 (e.g., a cylinder) of the control arm 306 is shown aligned to be inserted relative to a pivot mount 340 (e.g., a mating cylindrical surface) formed in the frame 324, and a washer 342 and a fastener 344 are shown aligned for engagement with the pivot mount 340 to secure the control arm 306 in pivoting relationship to the pivot mount 340. The control arm 306 being pivotable relative to the base 302 may permit a user to stand to the side of the machine 300 for viewing the field in front of the machine while still having readily reachable access to the control panel 308.

An example of electrical routing for components of the machine 300 is also shown in FIG. 6. An electrical box 346 is shown received in the frame 324. The electrical box 346 may include power supplies and/or other electrical components for processing power and/or data to other parts of the machine 300. The electrical box 346 may be modular in nature so that the entire electrical box 346 may be removed from the machine 300 for servicing. A power input cable 348 is shown extending from the electrical box 346, for example, to permit the machine 300 to receive electrical power from a 120V or other standard outlet. The frame 324 also defines a space 350 in which a self-contained power source (such as a battery or a generator) can be received, e.g., which may couple with the power cable 348 or otherwise permit the machine 300 to be powered without having a cable extending from the machine 300 that may be tripped over by players 106 or others moving around the machine 300. The electrical control box 346 and the space for the self-contained power source are each shown positioned near a bottom of the frame 324. Positioning relatively heavy objects such as the electrical control box 346 and/or the self-contained power supply low on the machine 300 may provide stability for the machine 300 and/or prevent the machine 300 from being top-heavy.

Figure 7:
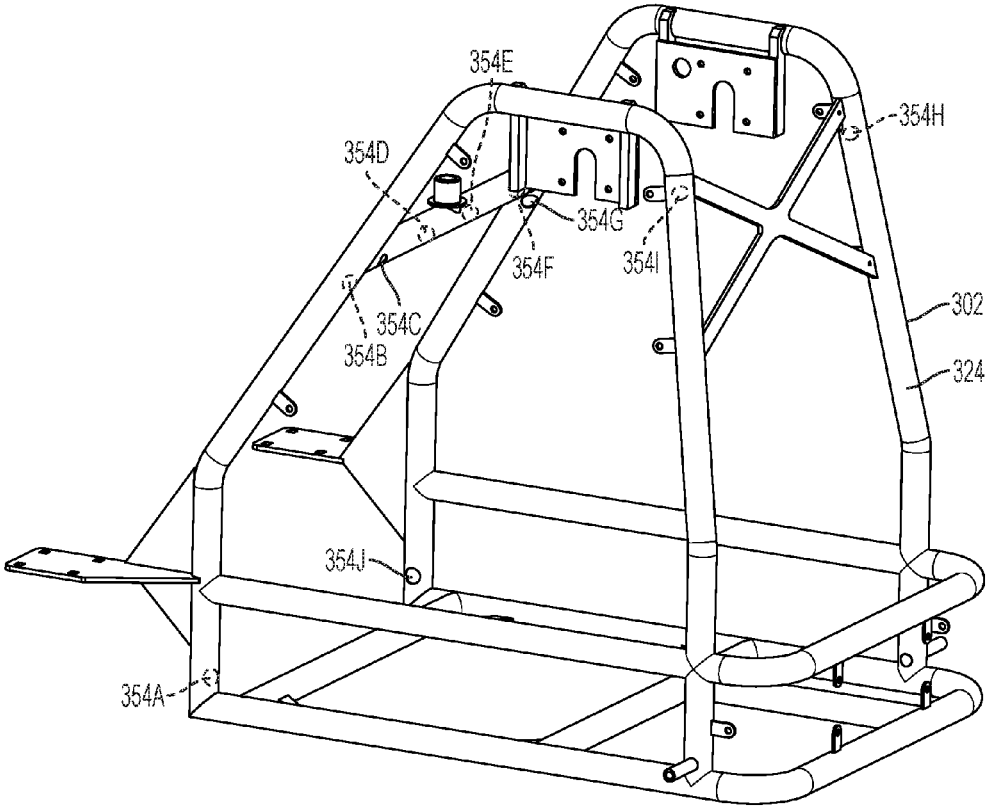
FIG. 7 is a side perspective view showing a frame of a base of the machine.

As may be seen in FIG. 7, the frame 324 may be formed of hollow tubes that include ports 354 through which wiring can pass between inside and outside of the tubes. Such construction may allow wiring to be routed inside of tubes of the frame 324 (e.g., to protect the main length of the wiring or obscure it from sight) and also permit the wiring to enter and exit to transition between different tubes of the frame 324. Connectors may be used to couple different portions of the wiring together, and the ports 354 may be positioned so that such connectors are readily accessible outside of the tubes of the frame 324. Placement of connectors outside of the tubes of the frame 324 may facilitate disconnecting portions of the wiring from each other (e.g., to facilitate removal of an individual component or section of wiring for maintenance or to facilitate disassembling the machine 300 for storage) and/or facilitate connecting portions of the wiring together (e.g., during set up or following replacement of parts in maintenance).

Various portions of the electrical routing are shown relative to the frame 324 in FIG. 6. For example, a quick-disconnect 352 is shown extending from the electrical box 346 and coupleable via a connector 356A to a segment of wiring 358A. The segment of wiring 358A is shown extending through a port 354A into a first tube of the frame 324, out through another port 354B, in through a further port 354C into a second tube of the frame 324, and out through yet another port 354D before terminating in a connector 356B. Another segment of wiring 358B runs from the control panel 308 down through a tube of the control arm 306 and then exits to expose another connector 356C. In this way, the connector 356C from wiring 358B to the control panel 308 and the connector 356B from wiring 358A to the electrical box 346 may both be located in proximity for respectively coupling with connectors 356D and 356E of another segment of wiring 358C that may carry data, power, and/or control signals to respective components located in the tower 304. For example, the wiring 358C for the tower 304 may extend in through a port 354E into a tube of the frame 324, out through another port 354F, in through a further port 354G into another tube of the frame 324, and out through a final port 354H, from whence it may be available for routing to the tower 304. In FIG. 7, the frame 324 also includes additional ports 354I and 354J, for example, which may be included to provide a symmetric arrangement of ports 354 that may permit routing of wiring 358 along either side of the frame 324, such as to accommodate a control box 346 that instead of having the quick-disconnect 352 closer to a right side of the frame 324 as in FIG. 6 has the quick-disconnect 352 closer to a left side of the frame 324.

Various components in the tower 304 may receive power in the manner just described, or via other methods of electrical routing. In many examples, components in the tower 304 may be controlled to change a manner in which the launcher 309 supported relative to the base 302 will deliver a football or other sports projectile.

Figure 8:
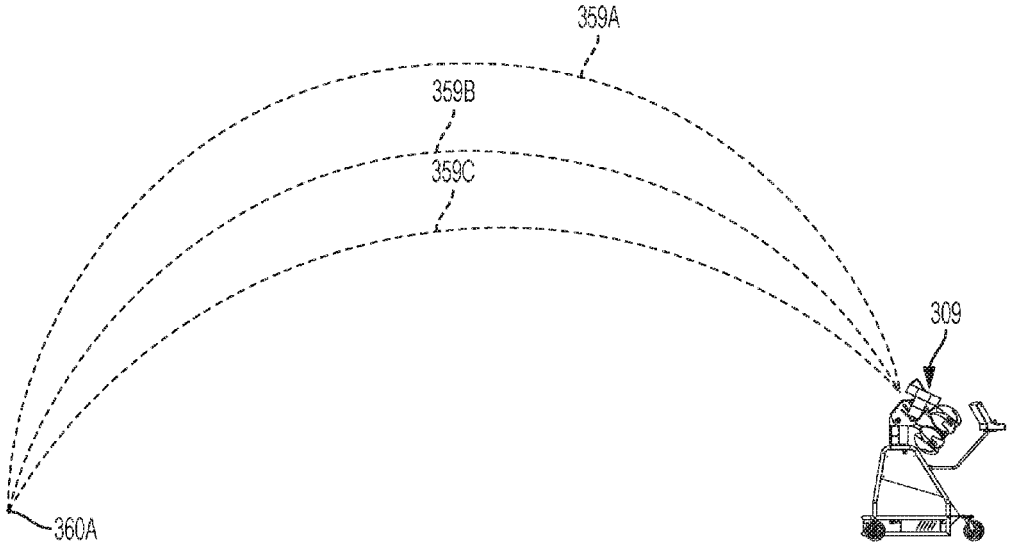
FIG. 8 is a side view showing a set of trajectories that may be utilized by the machine to deliver a sports projectile to a first target location.
Figure 9:
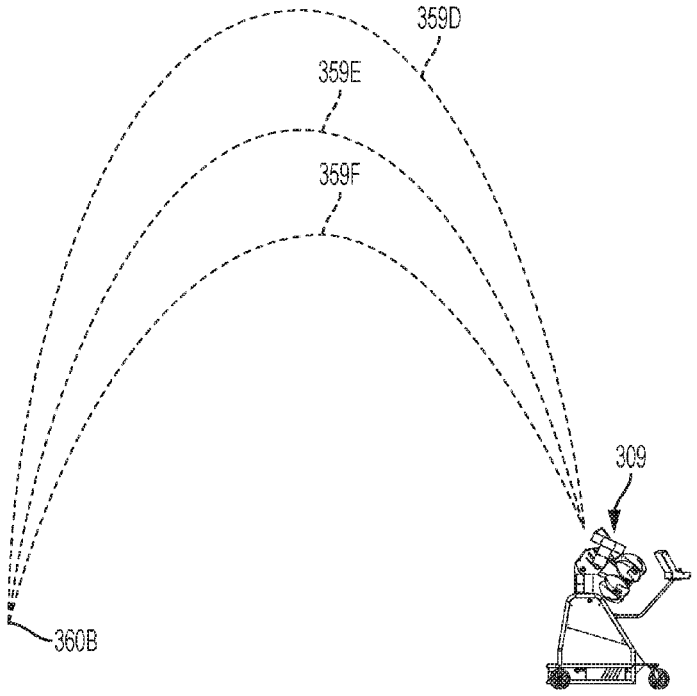
FIG. 9 is a side view showing a different set of trajectories that may be utilized by the machine to deliver a sports projectile to a different target location.

FIG. 8, for example, shows various trajectories 359 that the launcher 309 may utilize to deliver a football or other sports projectile to a first designated location 360A. The trajectories 359 may vary according to the initial angle or orientation of the launcher 309 and/or initial velocity imparted by the launcher 309. FIG. 9 similarly shows another set of trajectories 359 that the launcher 309 may utilize by varying orientation and/or imparted velocity to deliver to a second, different designated location 360B. Accordingly, settings that may affect initial orientation and imparted velocity may be adjusted to cause the launcher 309 to change a target destination 360 and/or trajectory 359 to reach a target destination 360. For example, the launcher 309 at a given orientation may deliver a ball a first, longer distance along one trajectory 359A (FIG. 8) to a first location 360A when the launcher 309 is set to impart a first, faster speed but may deliver the ball a second, shorter distance along a different trajectory 359F (FIG. 9) to a second, different location 360B when the launcher 309 is set to impart a second, slower speed.

The different trajectories capable by different settings of the launcher 309 may be captured at least partially in look up charts to facilitate targeted operation of the launcher 309. In one example, 6 different look up charts are utilized, each corresponding to a different height 0 through 10 feet above a field of play at 2-foot increments. The lookup charts may be initially populated by testing each of a large number of orientations (e.g., pitch) and imparted velocity (e.g., speed of rotors 310) and recording where the ball lands for each combination. Such a combination of settings and resulting landing point can provide a basis for determining where the ball will travel for a particular set of settings. Using the quadratic equation, it can be estimated where the ball will travel at a given distance, d. Testing can be performed to verify these assumptions for each angle and speed. An error coefficient can be measured comparing the height of the ball at d to what the expected value was. Recording this value and multiplying it through the table at each discrete, respective value, can provide an adjusted distance d' for each height 2-10 feet. Thus, for example, if input is received that a ball is to be thrown "above the athlete's head", rather than determining an analytical solution from scratch, the 8 foot look up chart can be searched (e.g., for the "distance" that the athlete is either at, or expected to be at) and the speed and orientation in the 8 foot lookup chart for that "distance" can be utilized to inform the settings of the launcher 309 (e.g., the orientation and speed) to be used for delivering the ball.

Figure 11:
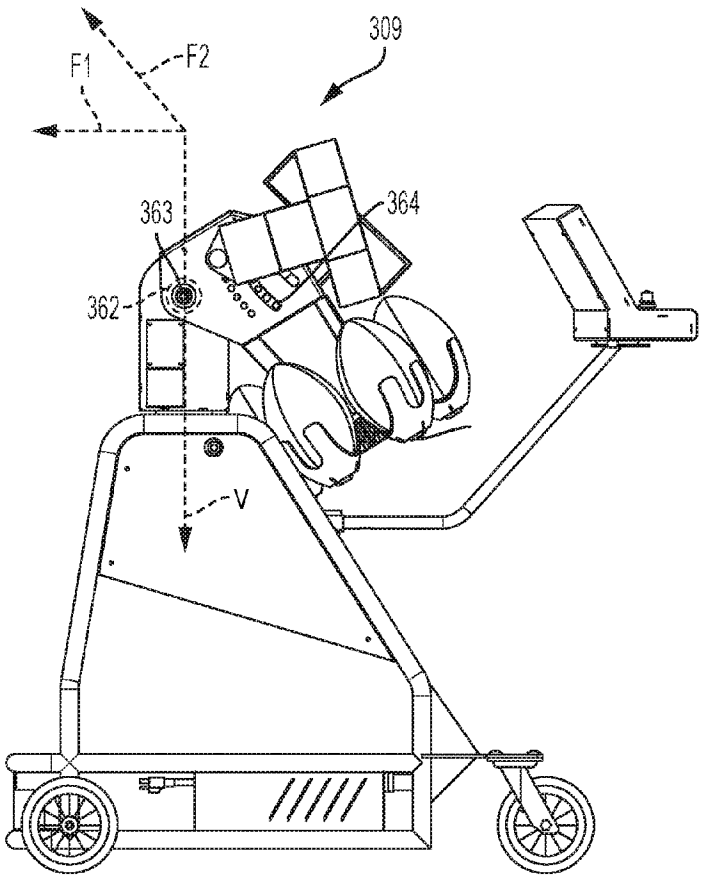
FIG. 11 is a side view showing a second position along the spectrum of pitch variation achievable by the machine.
Figure 10:
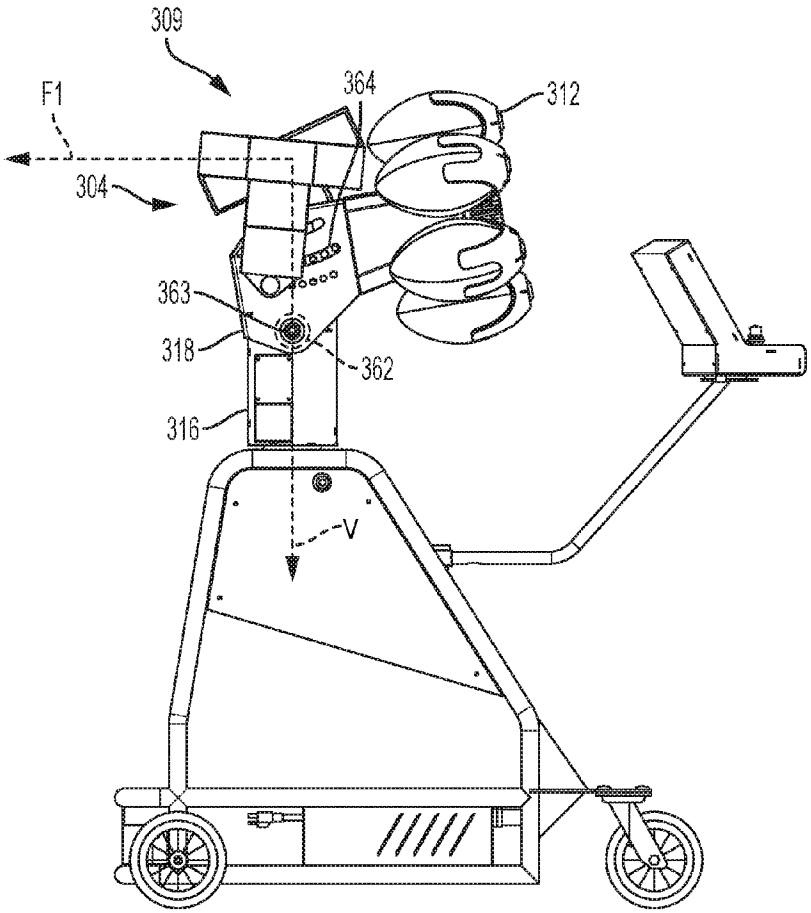
FIG. 10 is a side view showing a first position along a spectrum of pitch variation attainable by the machine.

Referring to FIGS. 10 and 11, the initial orientation of the launcher 309 may be adjusted by rotating the launcher 309 about a pitch axis 363. The pitch axis 363 is shown travelling into or out of the page in FIGS. 10 and 11. The second joint 318 of the tower 304 is shown having a pitch positioning motor 362 operable to change a position of the launcher 309 relative to the pitch axis 363. For example, with reference to FIG. 10, the launcher 309 is shown at a first facing direction F1 that is approximately 85 degrees away from a vertical downward direction V for the launcher 309. The pitch positioning motor 362 may turn a portion of the second joint 318 relative to the first joint 316 of the tower 304 about the pitch axis 363, which may cause the launcher 309 to tip backwards, e.g., toward the position shown in FIG. 11, in which the launcher 309 is at a second facing direction F2 tilted back approximately an additional 80 degrees from the first facing direction F1. The states shown in FIGS. 10 and 11 may correspond to end limits of the pitch adjustment that can be provided by the pitch positioning motor 362 in some examples, but different end points of the pitch adjustment range could also be used.

The pitch positioning motor 362 may correspond to any suitable electrically controllable adjustment device. Non-limiting examples include stepper motors or servo motors. Worm gears or other forms of suitable gearing may be utilized to provide an appropriate degree of mechanical transfer of force from the pitch positioning motor 362 to movable elements of the machine 300 to achieve appropriate degrees of electrically controllable movement.

The pitch positioning motor 362 may adjust a pitch orientation of the launcher 309 independent of other settings of the launcher 309. For example, in FIGS. 10 and 11, the rotors 310 are shown coupled with adjustment slots 364 that allow the rotors 310 to be tilted forward or backward to change the relative orientation between one rotor 310 and another rotor 310 (e.g., which may alter whether the rotors 310 will mimic a right-handed throw, a left-handed throw, or some other type of launch). The pitch positioning motor 362 may cause rotation of an entire section of the launcher 309 that includes the rotors 310, the adjustment slots 364, and the feeder 312 and thereby not affect the relative orientation of the rotors 310 one to another with respect to the type of motion they will impart when receiving a ball from the feeder 312.

Figure 13:
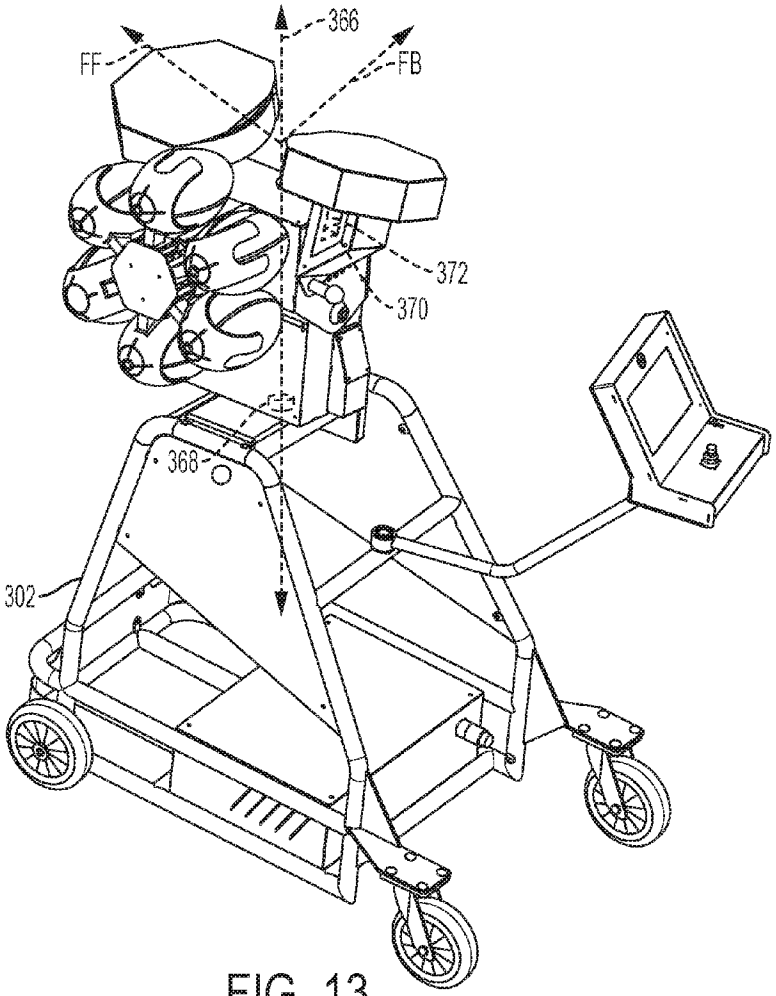
FIG. 13 is a side perspective view showing a second position along the spectrum of yaw variation achievable by the machine.
Figure 12:
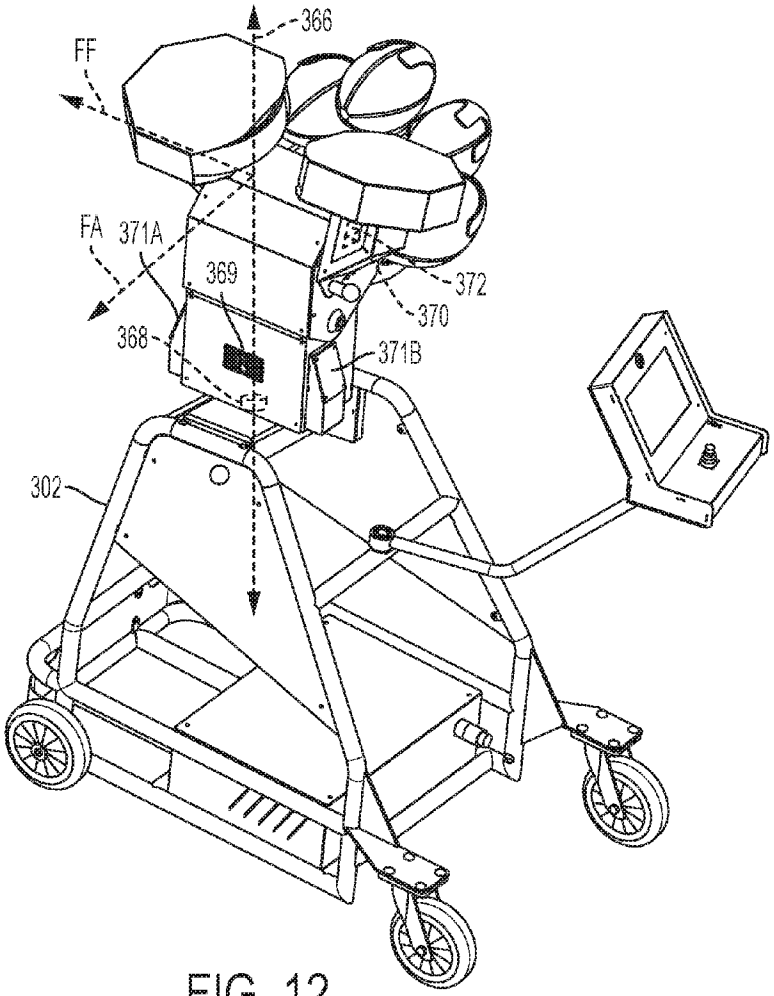
FIG. 12 is a side perspective view showing a first position along a spectrum of yaw variation attainable by the machine.

Referring to FIGS. 12 and 13, the initial orientation of the launcher 309 may be adjusted by rotating the launcher 309 about a yaw axis 366. The yaw axis 366 is shown travelling up and down on the page in FIGS. 12 and 13. The first joint 316 of the tower 304 is shown having a yaw positioning motor 368 operable to change a position of the launcher 309 relative to the yaw axis 366. For example, with reference to FIG. 11, the launcher 309 is shown at a first facing direction FA that is approximately 90 degrees away leftward from a forward facing direction FF for the launcher 309. The yaw positioning motor 368 may turn a portion of the first joint 316 relative to the base 302 about the yaw axis 366, which may cause the launcher 309 to swing rightward, e.g., toward the position shown in FIG. 13, in which the launcher 309 is at a second facing direction FB pivoted approximately 90 degrees rightward from the forward facing direction FF. The states shown in FIGS. 12 and 13 may correspond to end limits of the yaw adjustment that can be provided by the yaw positioning motor 368 in some examples, but different end points of the pitch adjustment range could also be used.

The yaw positioning motor 368 may correspond to any suitable electrically controllable adjustment device. Non-limiting examples include stepper motors or servo motors. Worm gears or other forms of suitable gearing may be utilized to provide an appropriate degree of mechanical transfer of force from the yaw positioning motor 368 to movable elements of the machine 300 to achieve appropriate degrees of electrically controllable movement.

Moreover, although the above description refers to the first joint 316 of the tower 304 including the yaw positioning motor 368 for pivoting about the yaw axis 366 and the second joint 318 of the tower 304 including the pitch positioning motor 362 for pivoting about the pitch axis 363, other arrangements are possible. For example, relative vertical placement could be inverted such that the first joint 316 of the tower 304 pivots about the pitch axis 363 and the second joint 318 of the tower 304 pivots about the yaw axis 366. Additionally or alternatively, instead of being located in separate joints, both the pitch positioning motor 362 and the yaw positioning motor 368 could be located within the same joint while being arranged to cause different forms of pivoting relative to opposite ends of that same joint.

Similar to the pitch positioning motor 362, the yaw positioning motor 368 may adjust a yaw orientation of the launcher 309 independent of other settings of the launcher 309. For example, the yaw positioning motor 368 may adjust the yaw orientation of the launcher independent of the pitch orientation of the launcher 309 and/or independent of the relative orientation of the rotors 310 and feeder 312 relative to one another.

The initial velocity imparted by the launcher 309 may be adjusted by controlling rotation of the rotors 310. For example, as shown in FIGS. 12 and 13, the rotors 310 may be coupled with speed controllers 370 to adjust a speed of rotation of the rotors 310. The speed controllers 370 may adjust a speed of rotor motors 372 that cause the rotors 310 to rotate. In some examples, the rotor motors 372 may include direct driven servo motors that are associated with respective feedback loops. The feedback loop can provide the ability to read the movement of the rotor and/or control the motor to operate at a specified level based at least in part on input provided through the feedback loop. For example, this may allow verification that the output of the rotor actually matches the level specified by the input signal. This may contrast, for example, with other varieties of motors that are simply controlled by potentiometers that vary an amount of current delivered to the motor without providing any indication of how the rotor varies based at least in part on that change. Use of a suitable feedback loop can allow accurate angle, velocity, and/or acceleration to be specified. Moreover, such an arrangement may address an issue that the load on a rotor 310 can throw off the positioning of a servo motor and cause the motor to fault if it encounters "inertial mismatch." For example, the feedback loop may provide an opportunity to re-calibrate and account for the variation in the positioning of the servo motor in such instances.

Figure 14:
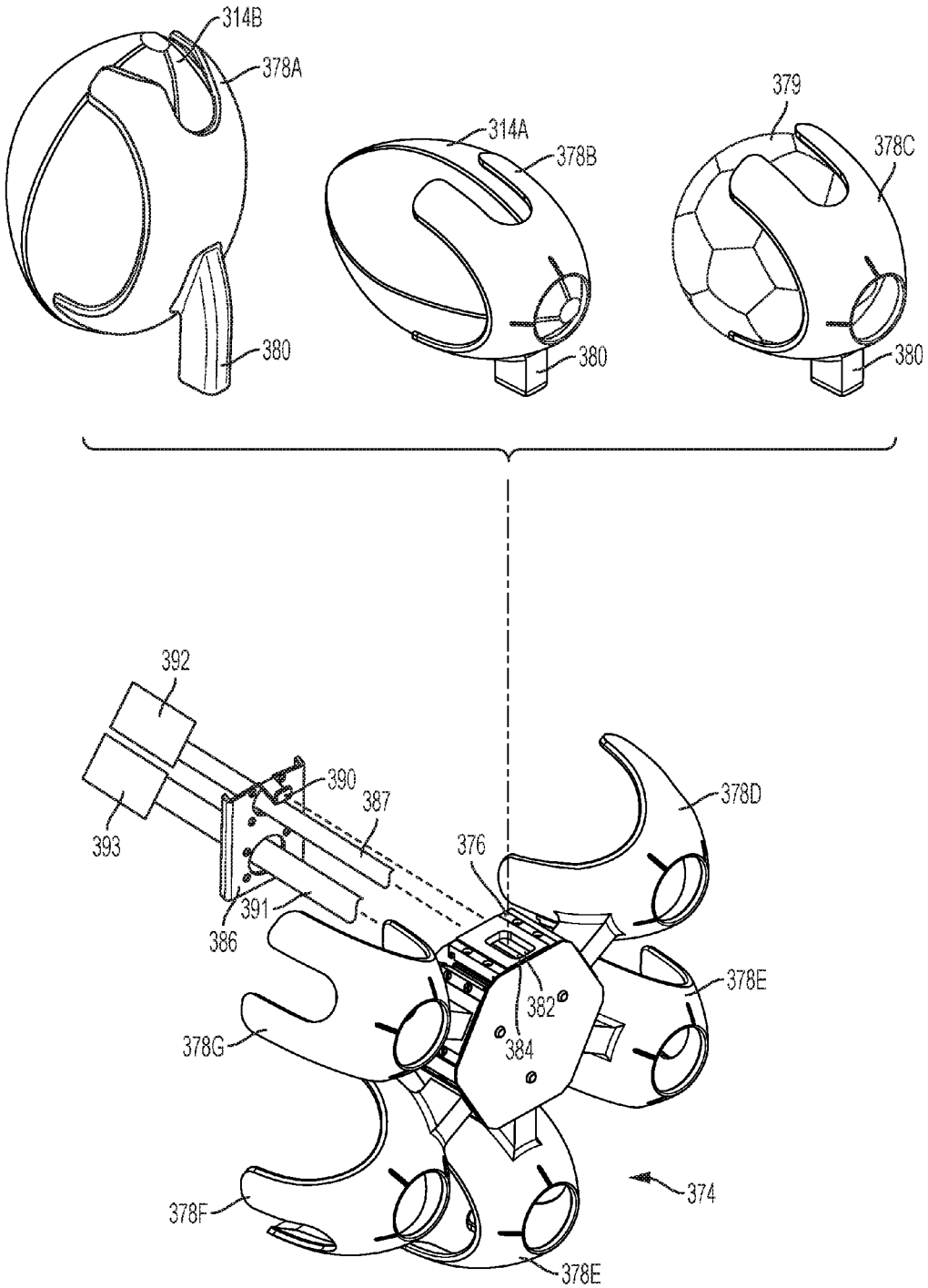
FIG. 14 is a partially exploded assembly view of a hub of a feeder for the machine.

FIG. 14 illustrates a partially exploded assembly view of a hub 374 of the feeder 312. The hub 374 carries a plurality of carriers 376, which in turn receive holders 378. The holders 378 are shaped to hold respective sports projectiles. The holders 378 may be swappable relative to the carriers 376. The holders 378 being swappable may allow implementation of holders shaped to hold different varieties of sports projectiles and/or holders shaped to hold a given sports projectile at relatively different orientations. For example, FIG. 14 shows one holder 378A that will introduce the football in a vertically tilted orientation relative to the rotors 310 (e.g., to simulate a kicked football), another holder 378B shaped to hold a football 314A at an orientation that will introduce the football in a horizontal or less-vertically-tilted orientation relative to the rotors 310 (e.g., to simulate a thrown football), and a further holder 378C shaped to hold a soccer ball 379 instead of a football 314. In FIG. 14, the holders 378 each include a standardized feature 380 (e.g., shown as a stem) that allows each holder 378 to alternatively or respectively be received relative to a standardized mounting interface (e.g., a socket 382) of the carrier 376. The socket 382 of the carrier 376 is also depicted as including a magnet 384 for magnetically coupling the holder 378 with the carrier 376 when the holder 378 is received by the carrier 376, although the magnet 384 could be at any other suitable location on or in the holder 378 or the carrier 376.

In FIG. 14, the hub 374 is also shown relative to a rotator 393, grabber 386, and an actuator 392. The rotator 393 may correspond to a motor coupled by a shaft 391 to the hub 374 or to any other structure capable of rotating the hub 374 to move further holders 378 into a position for actuating. In operation, the grabber 386 may be moved by the actuator 392 (e.g., along a guide rod 387 and/or around the shaft 391 for the rotator 393) relative to the hub 374 (e.g., to move respective carriers 376 and/or holders 378 relative to the hub 374, such as in a manner described below with reference to FIGS. 15-20).

Figure 15:
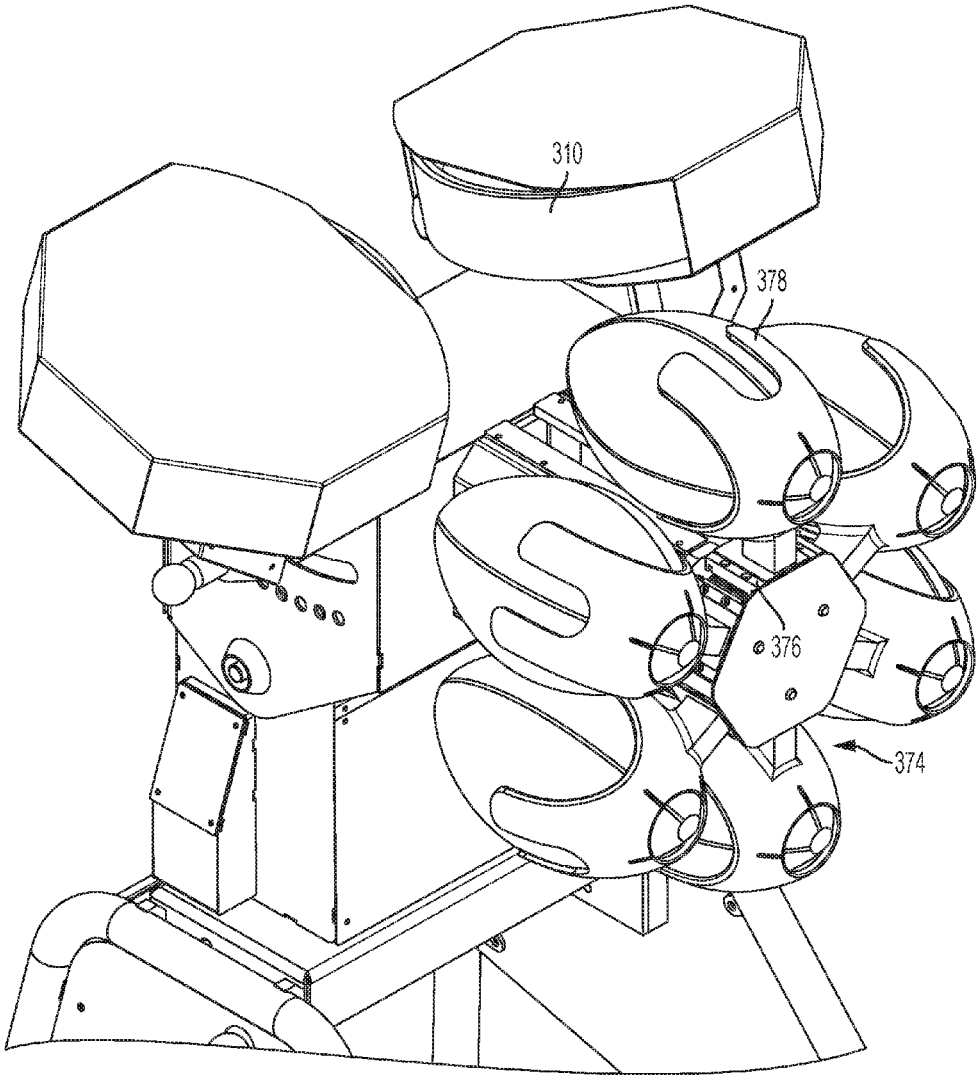
FIG. 15 is a side perspective view of a holder holding a football in a primed position relative to a launcher of the machine.
Figure 16:
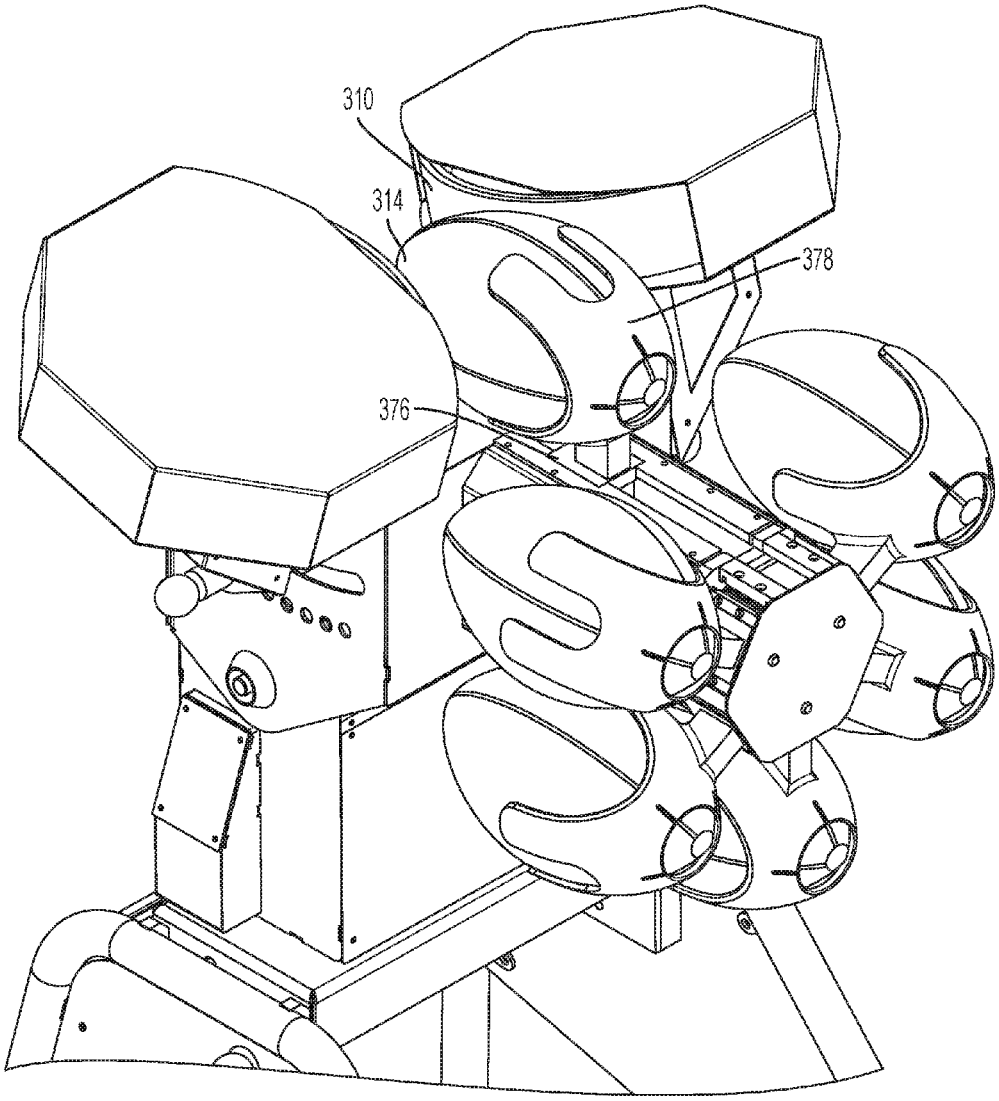
FIG. 16 is a side perspective view of the holder holding the football in a launching position relative to the launcher of the machine.
Figure 17:
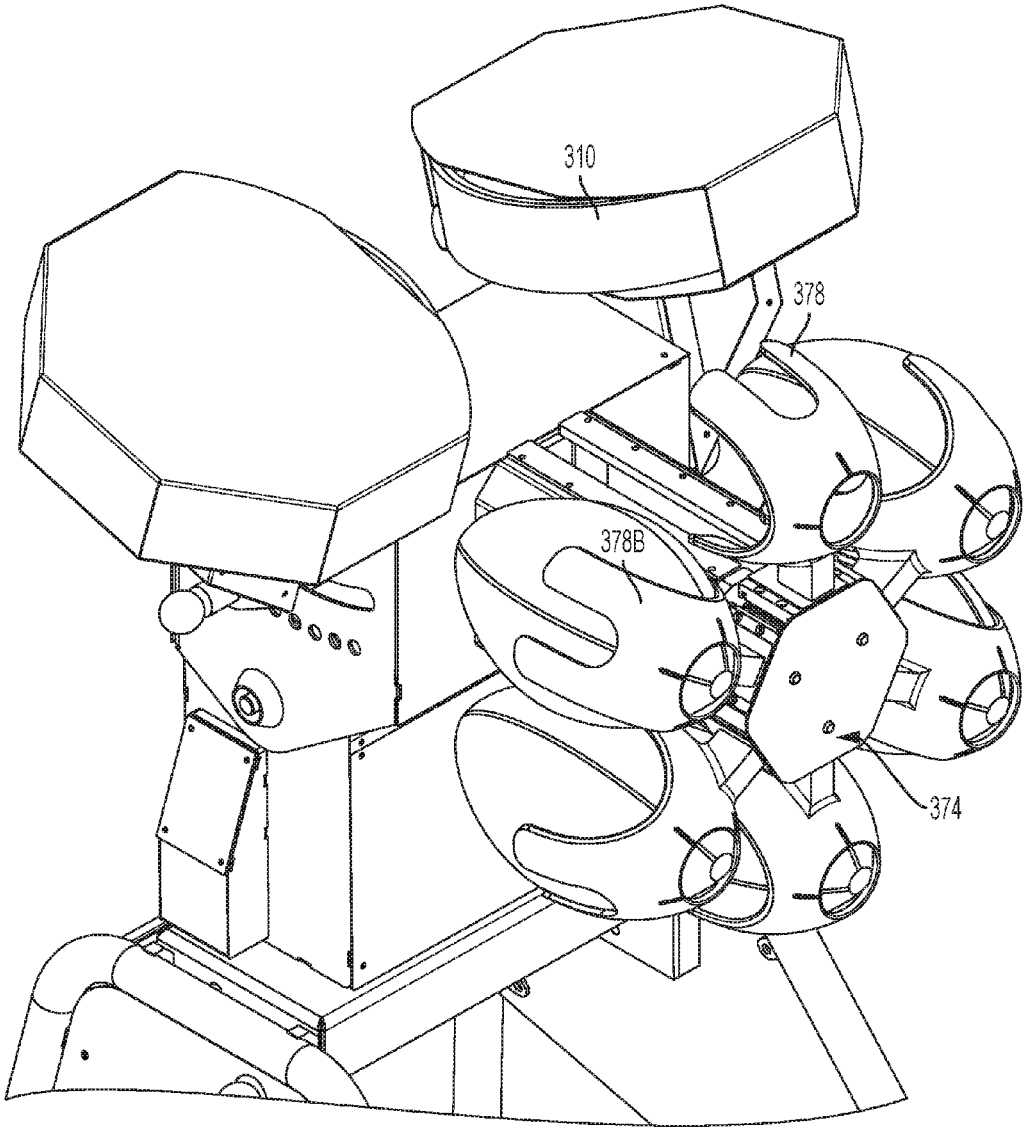
FIG. 17 is a side perspective view of the holder absent the ball and returned to the primed position relative to the launcher of the machine.

In FIG. 15, the hub 374 has positioned a carrier 376 and respective holder 378 in a primed position. In FIG. 16, the carrier 376 and holder 378 have been moved toward the rotors 310 so that the football 314 may contact the rotors 310 and be launched. In FIG. 17, the now-empty carrier 376 has been moved back to the hub 374 and into the primed position. With all of the carriers 376 on the hub 374, the hub 374 may rotate to bring a new holder 378B into the primed position for readiness to repeat the firing process and fire the next ball. The mechanism by which the carrier 376 is moved relative to the hub 374 and the rotors 310 may be appreciated with reference to FIGS. 18-20.

Figure 18:
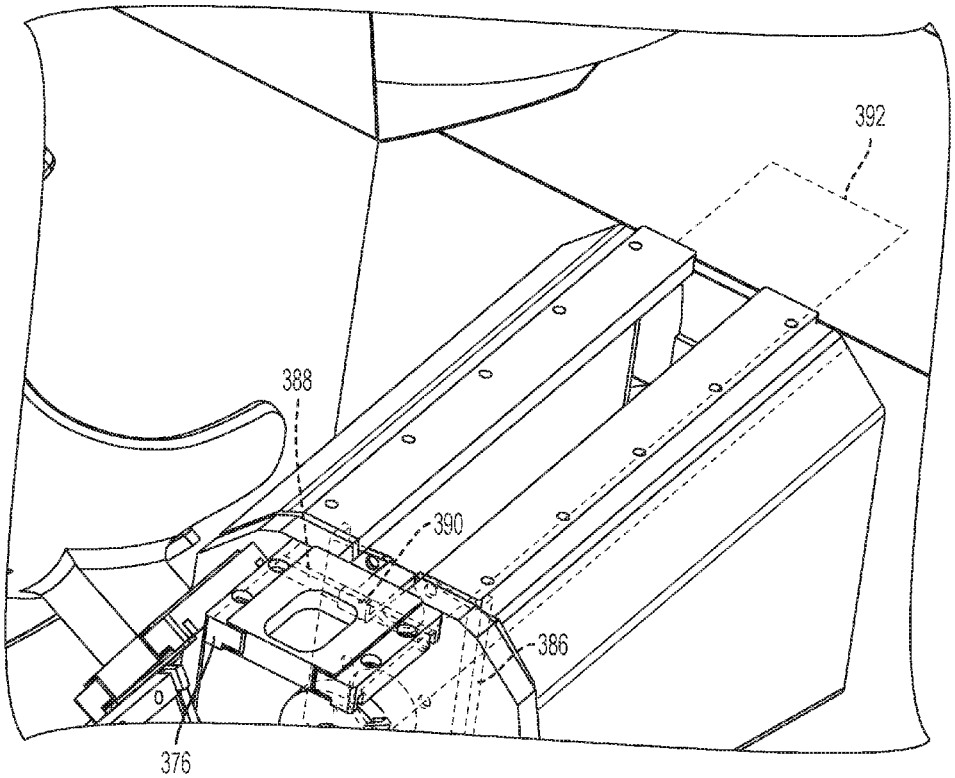
FIG. 18 is a top perspective view of a carrier for the hub in a primed position with the holder removed for ease of viewing.

In FIG. 18, the carrier 376 is shown in the primed position (similar to as shown in FIGS. 15 and 17), with the holder 378, rotator 393, shaft 391, and guide rod 387 omitted for ease of viewing. A grabber 386 is shown engaging the carrier 376. Specifically, the carrier 376 is shown with a slot 388 (e.g., a first engaging feature) on the underside in which a projection 390 (e.g., a second engaging feature) of the grabber 386 is engaged. Although description herein will focus on this depicted example for the sake of clarity, in some examples, the particular structure of the first engaging feature and the second engaging feature can be switched (e.g., so that the first engaging feature of the carrier 376 is a projection that engages a slot that corresponds to the second engaging feature of the grabber 386) and still accomplish comparable functions. The grabber 386 is coupled with an actuator 392 that can move the grabber 386. In one example, the actuator 392 is a motor operable to drive the grabber 386 backward or forward along a shaft, although the actuator 392 could be a pneumatic cylinder or any other form of linear actuator. Movement of the grabber 386 by the actuator 392 can cause the projection 390 of the grabber 386 to pull against the front edge of the slot 388 to pull the carrier 376 off of the hub 374 and toward the rotors 310, for example, toward the position shown in FIG. 19.

Figure 19:
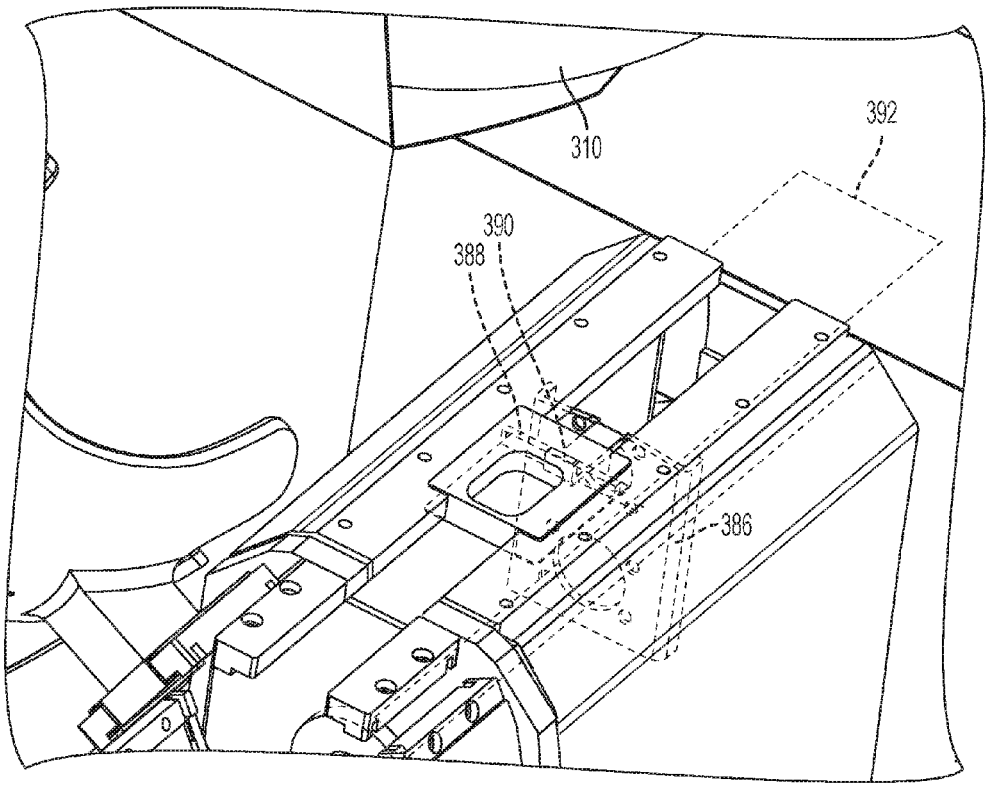
FIG. 19 is a top perspective view of the carrier in a launching position with the holder removed for ease of viewing.

In FIG. 19, the carrier 376 has travelled off of rails of the hub 374 and onto other rails separate from the hub 374. The position shown in FIG. 19 may correspond to a fired position of the feeder 312. The actuator 392 may be operated to return the carrier 376 back to its primed position. For example, the grabber 386 may be moved by the actuator 392 such that the projection 390 of the grabber 386 pushes against the back edge of the slot 388 to push the carrier 376 back onto the 374 and away from the rotors 310. The hub 374 may rotate when the fired carrier 376 has been received anew on the hub 374.

Figure 20:
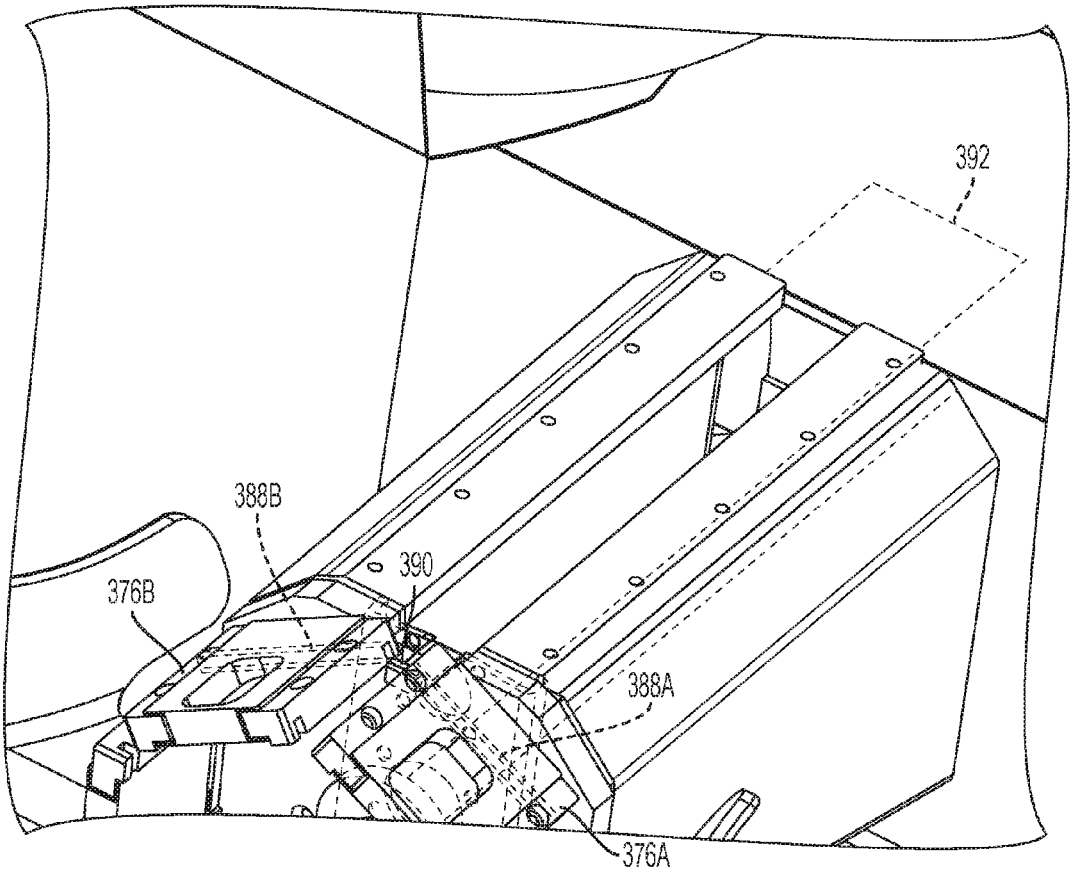
FIG. 20 is a top perspective view of a hub in a partially rotated state for transitioning for a different carrier into the primed position.

For example, FIG. 20 shows the hub 374 in mid-rotation. The projection 390 of the grabber 386 may remain in place as the hub 374 rotates, which may allow the slot 388A of one carrier 376A to shift away from an engaging position about the projection 390 and bring the slot 388B of an adjacent carrier 376B over the projection 390 instead. Thus, in mid-rotation of the hub 374 as shown in FIG. 20, at least a portion of the projection 390 may be in between respective slots 388 of adjacent carriers 376.

Figure 21:
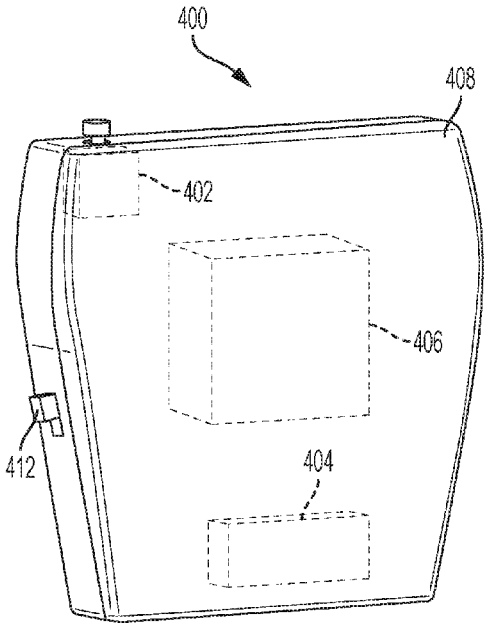
FIG. 21 is a front view of a wearable device for use in the sports projectile delivery system.
Figure 22:
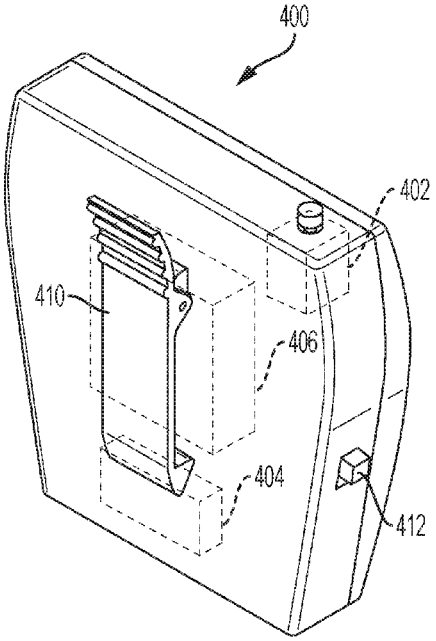
FIG. 22 is a rear perspective view of the wearable device.

FIG. 21 shows a front view of wearable device 400. The wearable device 400 is an example of the player tag 107. The wearable device 400 is shown with a communications subsystem 402, a vibrating alert component 404, and an auditory alert component 406 within a case 408. FIG. 22 is a rear perspective view of the wearable device 400 and illustrates a securing mechanism 410. The securing mechanism 410 is illustrated as a clip that may hook onto clothing of a player 106, although the securing mechanism 410 may additionally or alternatively include a watch strap, a belt loop, a necklace, a body harness, a headband, or any other component for securing the wearable device 400 to a player 106. In operation, the communication subsystem 402 may communicate with the computer system 202, e.g., to provide information about a location of the wearable device 400 and/or to receive signals for operating other components of the wearable device. For example, the communication subsystem 402 may receive signals that cause the auditory alert component 406 to emit a sound and/or cause the vibrating alert component 404 to vibrate, e.g., to cue the player 106 that a route or drill is beginning or ending. The communication subsystem 402 may form a part of the communication interface module 212. The wearable device 400 is also shown with a user control 412. The user control 412 is depicted as an on/off switch, but may additionally or alternatively include a button, touch screen, or any other component for receiving user input (e.g., which may be utilized for allowing a player 106 to indicate when ready for a drill, whether a ball was caught, or to provide any other form of input to the system).

Figure 23:
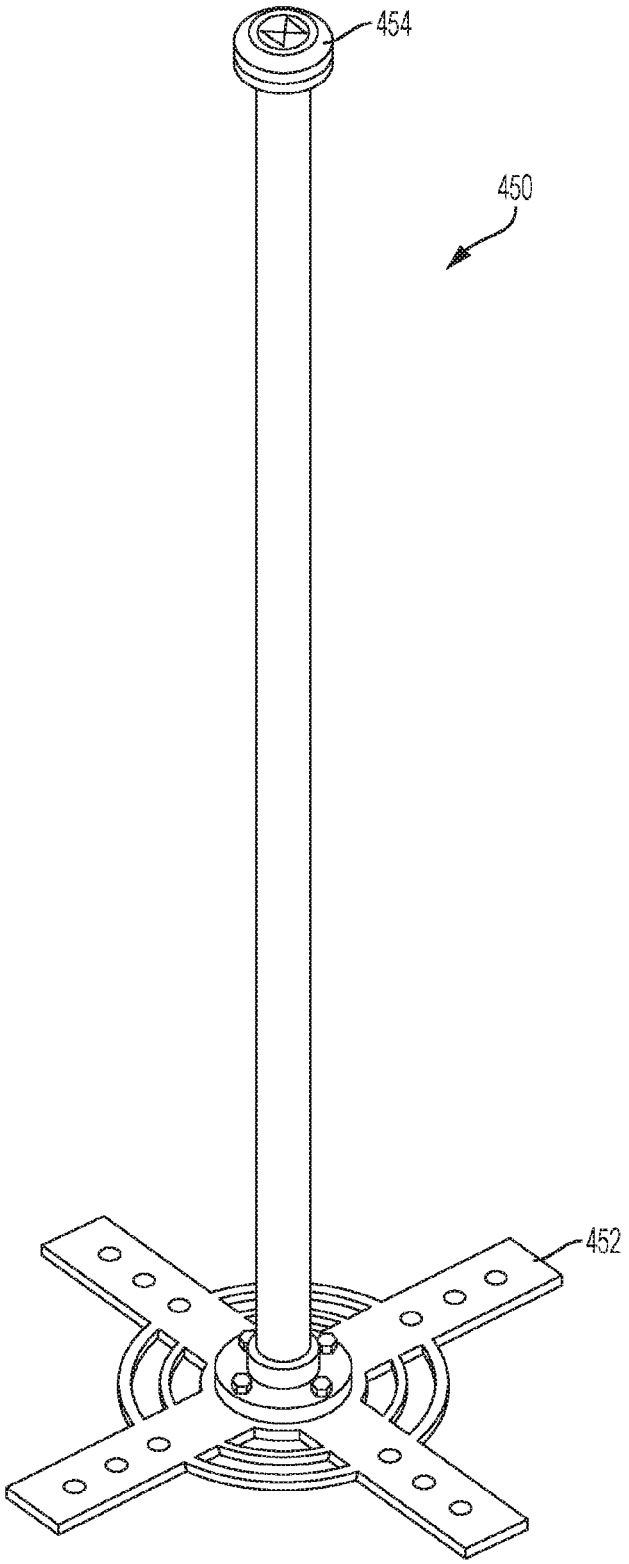
FIG. 23 is a side perspective view of an anchor for use in the sports projectile delivery system.

FIG. 23 shows an example of a marker 450. The marker 450 may be an example of the anchors 104. The marker 450 includes a stand 452 for maintaining the marker 450 upright. The marker 450 also includes a positioning component 454 that can provide information about a location of the marker 450. For example, the positioning component 454 may be an example of location sensor 208.

Figure 24:
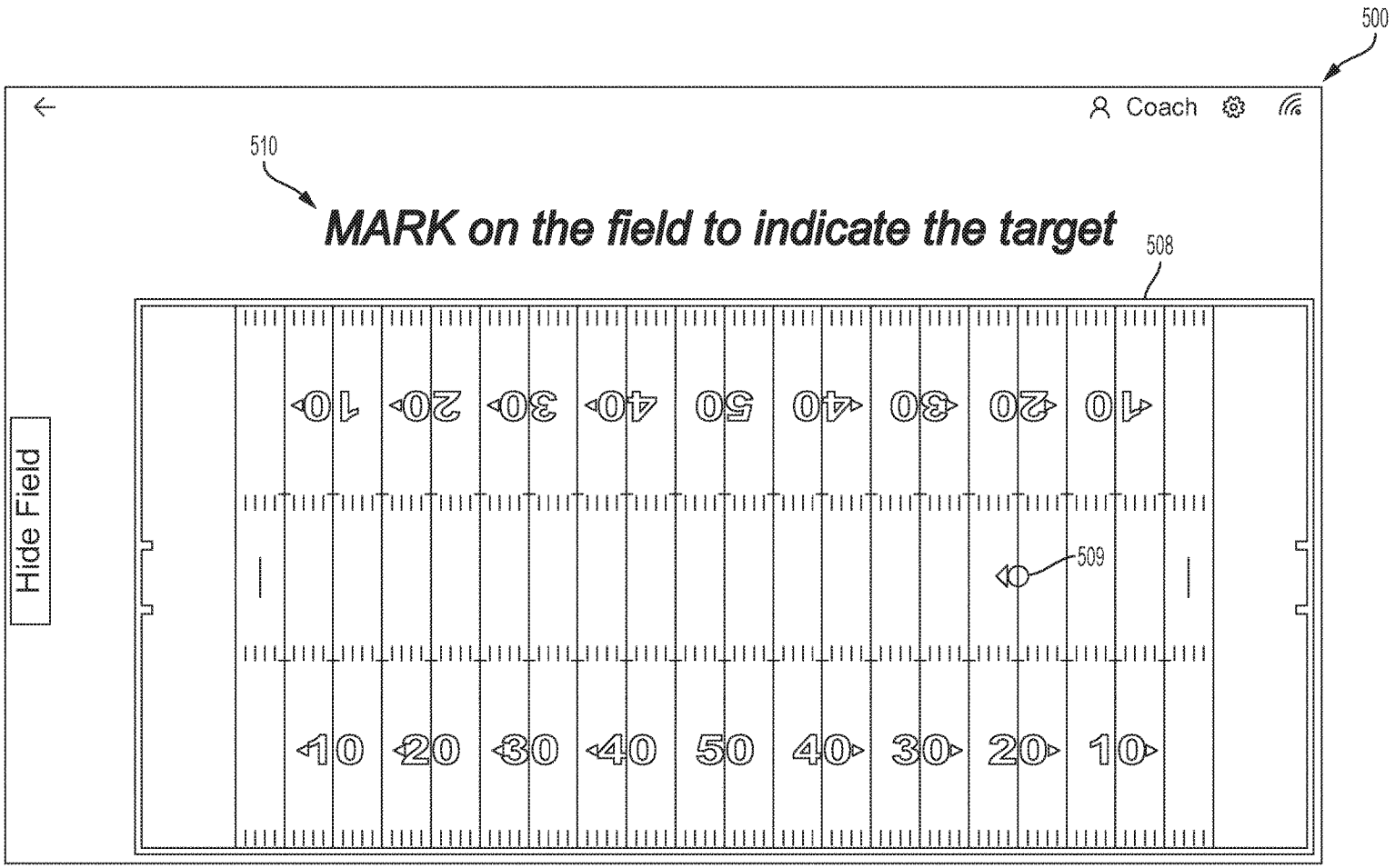
FIG. 24 is a representation of a user interface for providing input about a target delivery location for a sports projectile.

FIG. 24 illustrates an example of a user interface 500 that may be displayed to facilitate operations of the system 200. The user interface 500 may be displayed for example on the display 320 of the control panel 308. The user interface 500 shows a virtual representation of a field 508 and a virtual representation of the launcher 509. For example, with reference to FIG. 1, this may reflect a position of the launcher 102 relative to the field 108. The virtual representation of the launcher 509 may be placed on the virtual representation of a field 508 based at least in part on input received from one or more location sensors 208 and/or the locating module 220. The user interface 500 also includes a prompt 510 for the user to indicate a target location for delivery on the virtual representation of a field 508. For example, the user may be able to tap a location on a touch screen, navigate a cursor with a joystick, or otherwise enter a location.

Figure 25:
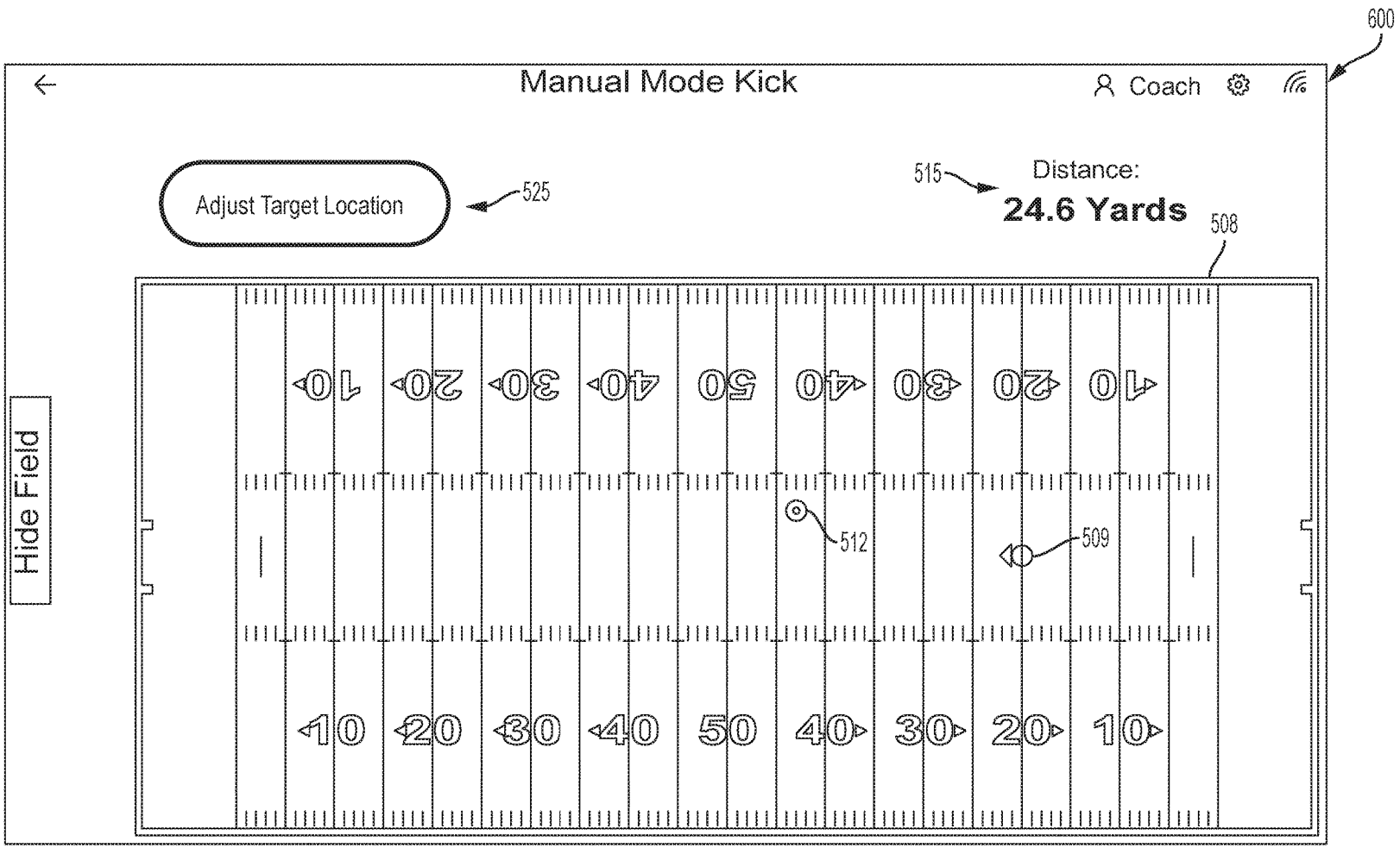
FIG. 25 is a representation of a user interface for providing a visual representation of a target delivery location for a sports projectile.

FIG. 25 illustrates an example of another user interface 600. The user interface 600 may be an updated version of the user interface 500. For example, the user interface 600 shows a virtual representation of the selected target location 512 relative to the virtual representation of the field 508. The user interface 600 shows additional information 515 based at least in part on the selection. For example, in FIG. 25, the additional information 515 includes a distance between the launcher 509 and the target location 512, e.g., calculated based at least in part on a selected target location 512 and a known location of the launcher 509. The user interface 600 also shows revision options 525. Although the revision options 525 are depicted as possible selections to adjust the location of the target 512, the revision options 525 may include additional criteria for selection.

Figure 26:
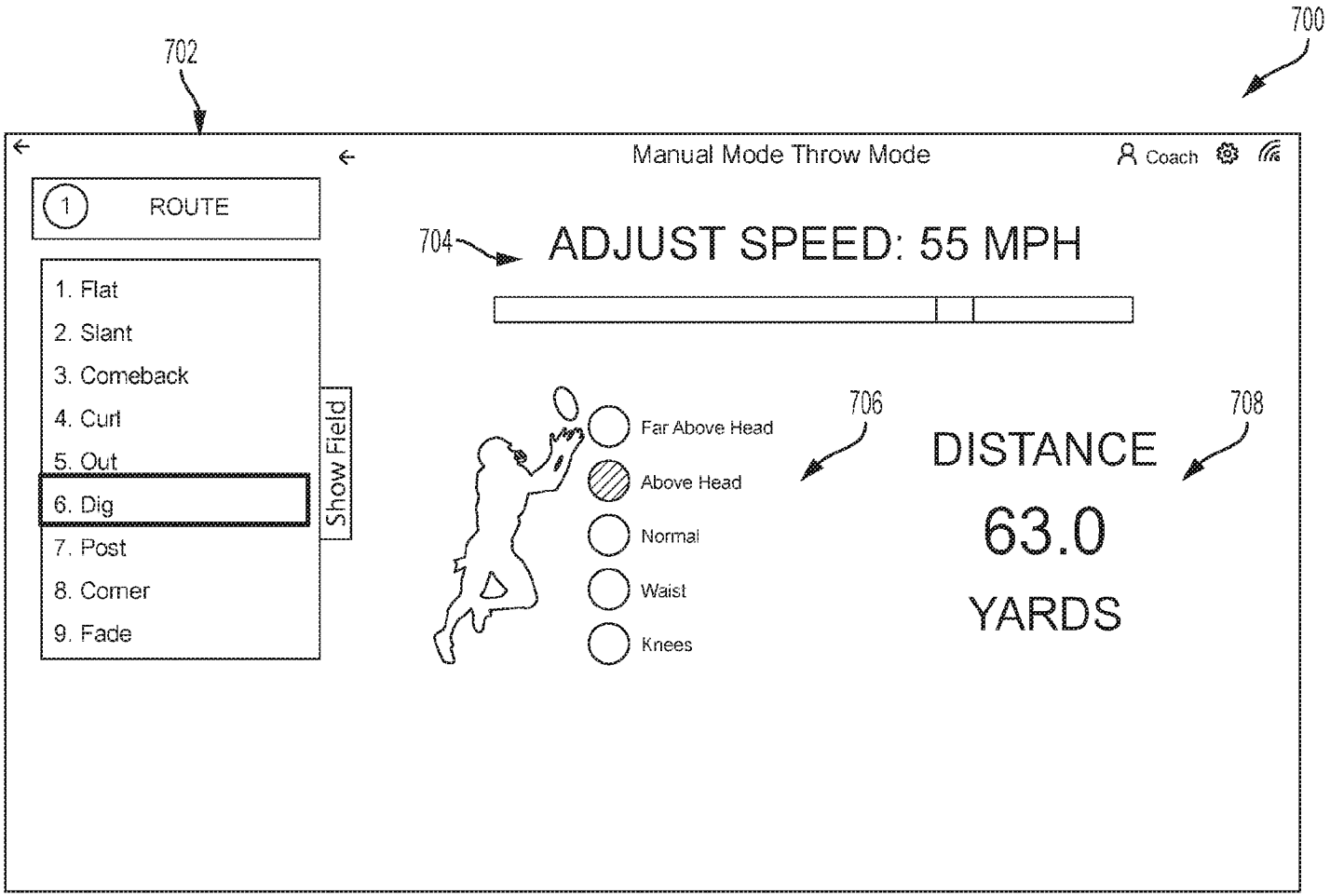
FIG. 26 is a representation of a user interface for providing user input regarding criteria for delivery parameters of a sports projectile.

FIG. 26 illustrates an example of a further user interface 700 indicating user-defined options for delivery of the sports projectile. For example, at 702, the user is able to select a type of route to run. At 704, the user can select a speed at which the ball is to be delivered to the target location. At 706, the user can select a relative placement of the ball to the user's body. At 708, the user may see (and/or revise) a distance that the ball is to travel for the projected delivery.

Figure 27:
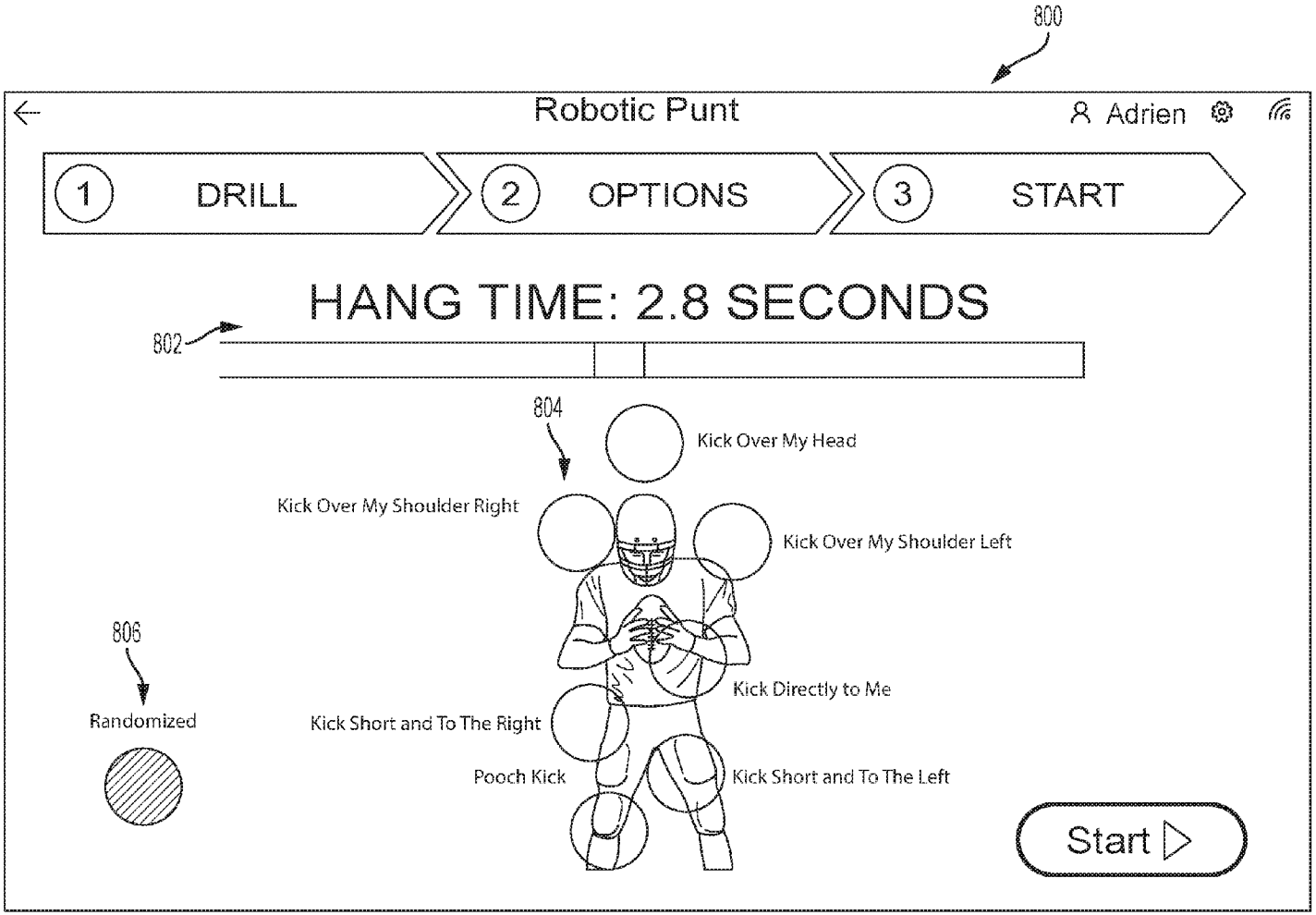
FIG. 27 is a representation of another user interface for providing user input regarding criteria for delivery parameters of a sports projectile.

FIG. 27 illustrates another example of a user interface 800 indicating another set of user-defined options for delivery of the sports projectile. The options are displayed with reference to a punt drill rather than a throwing drill, yet options are not necessarily limited to one phase or another, and any desired combination of options may be utilized for a given drill or operation. At 802, the user may select an amount of time the ball is to be in the air (e.g., during travel between the launcher 102 and the target location 112.). At 804, the user may select a placement of the ball relative to the user's body. At 806, the user may also have the option to select a random rather than a specific setting for an option. For example, although the randomizing option is shown for the body placement, randomizing could additionally or alternatively be provided as an option for an amount of time before the ball is to be launched, a distance the route is to last, a speed of delivery of the ball, or any other option for customizing delivery of the sports projectile.

A relevant portion of the system 200 (such as the planning module 218) may receive a variety of inputs such as those described with reference to FIGS. 24-27 and determine a plan for controlling the launcher aiming system 206 and the launching system 204 accordingly to provide delivery that satisfies the combined criteria. For example, such criteria may be input in a "manual mode" in which tracking is not utilized. However, in other examples a "robotic mode" that utilizes tracking may nevertheless allow such input and utilize it to plan for delivering according to a determined route 110, subject to updating to an actual route 117 based at least in part on the tracking.

Additionally, the user interfaces discussed in FIGS. 24-27 are not limited to presentation on the display 320 of the control panel 308. For example, such user interfaces may be presented remotely from the machine, such as on an internet-connected device for a player or coach to input criteria for drills or otherwise plan or review performance of the system 200 and/or users thereof.

Figure 28:
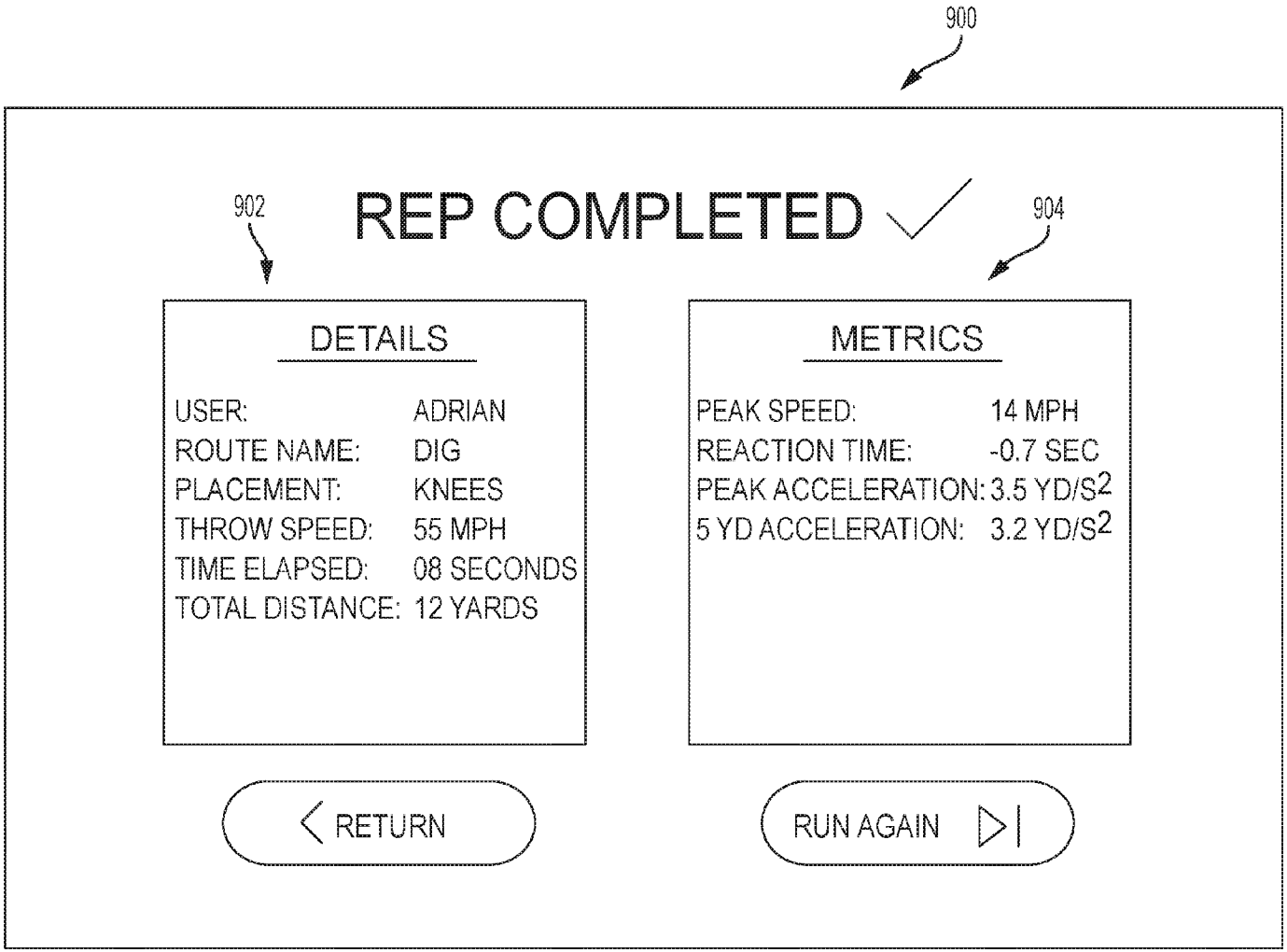
FIG. 28 is a representation of a user interface for providing a summary of information associated with a performed delivery of a sports projectile.

FIG. 28 illustrates an example of a further user interface 900 reflecting the results of a drill. At 902, the user interface reflects details corresponding to a delivery by the launcher. For example, the details may include placement, speed, elapsed time, and distance of a delivery by the launcher. At 904, the user interface reflects metrics of a tracked player. For example, the metrics may include speed, reaction time, acceleration, or other details that may be derived from the tracking of the player during the drill. The user interface 900 reflects that the system 200 may track various criteria of a player and/or launcher during a route or drill and store the information for later review. In some examples, the system may be set to repeat a drill until a player satisfies metrics for the drill or opts to move on to a different drill.

Figure 29:
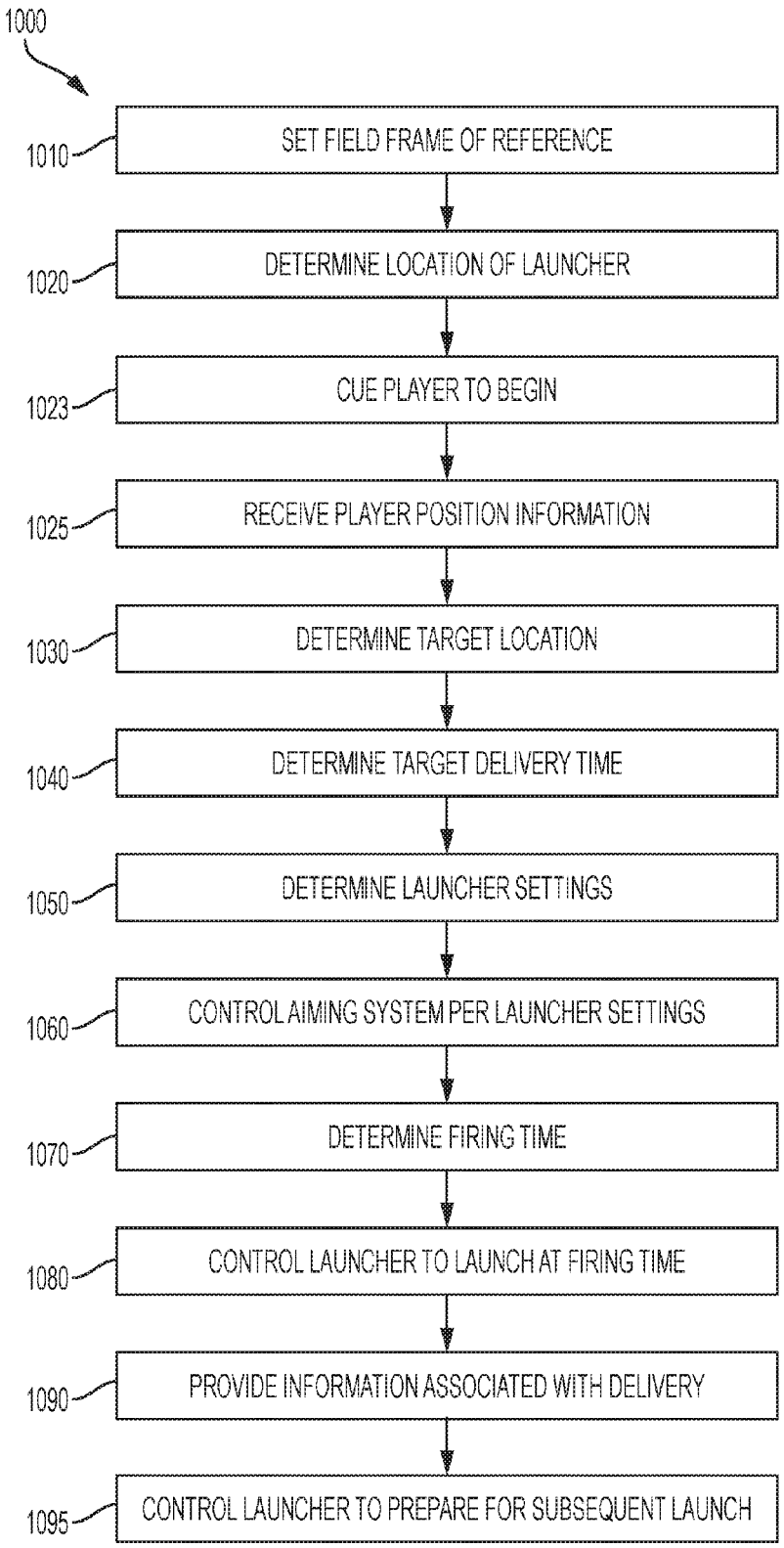
FIG. 29 is a flowchart illustrating a process for providing a targeted delivery of a football or other sports projectile according to various embodiments.

FIG. 29 is a flowchart illustrating a process 1000 for providing a targeted delivery of a football or other sports projectile according to various embodiments. Some or all of the process 1000 (or any other processes described herein, or variations and/or combinations thereof) may be performed under the control of one or more computer systems configured with executable instructions, such as the modules described herein, and may be implemented as code (e.g., executable instructions, one or more computer programs or one or more applications) executing collectively on one or more processors, by hardware or combinations thereof. The code may be stored on a computer-readable storage medium, for example, in the form of a computer program including a plurality of instructions executable by one or more processors. The computer-readable storage medium may be non-transitory. Moreover, unless indicated otherwise, acts shown in the processes are not necessarily performed in the order shown, and/or some acts can be omitted in embodiments.

The process at 1010 includes setting a field frame of reference. This may include receiving information about the location of anchors 104 relative to the field. In one example, the anchors 104 may have designated locations associated with them (e.g., marked to be placed at the 50-yard line, the end zone line, or at other respective reference points of the field) such that the locating module 220 receives respective signals from the anchors 104 and automatically correlates the location of the anchors 104 with the associated reference points on the field. In another example, the anchors 104 may have indicia associated with them, and a user may be prompted to input where on the field respective anchors have been placed so that location information from the anchors can be correlated to reference points on the field. The field frame of reference may be utilized for any subsequent location actions to determine relative location of other components to the field and/or one another.

The process at 1020 includes determining a location of the launcher. In one example, the location of the launcher may be based at least in part on the field frame of reference determined at 1010. In another example, a user may be prompted to input a location of the launcher relative to the field. In some examples, the launcher may be a reference point from which all other location references are figured.

The process at 1023 includes providing a cue to a player to begin. This may correspond to activating or otherwise controlling components to alert the player to begin running a route or drill. As an illustrative example with reference to elements identified in FIGS. 12 and 21, this may entail activating lights 371A and 371B (FIG. 12) on the machine 300, activating a speaker 369 (FIG. 12) on the machine 300, and/or activating a vibrating alert component 404 (FIG. 21) of a wearable device 400. However, other forms of the user interface 210 may be utilized for such operations.

The process at 1025 includes receiving a player position. This may entail tracking the player based at least in part on information from the player tag 107. The player position may be used for subsequent determinations.

The process at 1030 includes determining a target location. In some examples, this may entail the user inputting a particular location, for example, relative to the field or the launcher. In some examples, this may entail determining a location based at least in part on the end location of a pre-determined route. In some examples, this may entail determining a location based at least in part on the tracked movement of a player, for example, based at least in part on information received at 1025. In some examples, this may entail determining a location based at least in part on one or more user-input criteria such as speed at which the projectile is to be travelling when launched and/or when arriving to the target, time between route start and end, time between ball launch and arrival to target, delivery location relative to a player's body, distance between launcher and target location, a type of drill or route to be performed, or any other user-input criteria. For example, the user-input criteria may be utilized to determine appropriate trajectories that may be utilized to satisfy the criteria. In some examples, the target location (or associated criteria) may be determined based at least in part on an assignment set by a coach or otherwise programmed for a player to complete, such as may be retrieved on the player's behalf from the database.

The process at 1040 includes determining a target delivery time. In some examples, the target delivery time may be based at least in part on a predetermined route (e.g., which may be based at least in part on other user input, such as that described above with reference to 1030). In some examples, the target time is determined based at least in part on information about a player's position obtained at 1025.

The process at 1050 includes determining launcher settings for the delivery. This may entail determining a target orientation for the launcher and/or a target initial velocity to be imparted by the launcher. For example, this may include determining a pitch orientation, a yaw orientation, and an imparting speed that can satisfy criteria for the delivery. For example, the planning module 218 may determine suitable settings for the launcher based at least in part on the delivery criteria of the target location and/or target delivery time.

The process at 1060 includes controlling the aiming system per the launcher settings. For example, the planning module 218 may control the aiming system 206 to implement the launcher settings determined at 1050, such as by controlling the pitch positioning motor 362 to arrange the launcher 309 at a suitable pitch, controlling the yaw positioning motor 368 to arrange the launcher 309 at a suitable yaw, and controlling the rotors 310 of the launcher 309 to reach a suitable speed for imparting the intended initial velocity.

The process at 1070 includes determining a firing time. In some examples, this may entail receiving a user input about when to fire (e.g., firing immediately in response to a user button push, or allowing a user to enter or designate a particular future firing time or delay until firing). In some examples, this may be based at least in part on a comparison of a "ball to target" time and a "user time to target." In some examples, this may be based at least in part on an expected lag time between providing a signal to fire and actual firing of the launcher 204. In some examples, this may be based at least in part on a calculation related to the target delivery time determined at 1030.

The process at 1080 includes controlling the launcher to launch at the firing time. For example, this may include providing a command to the feeder 312 to move a holder 378 toward the rotors 310 so that the football will be launched. As an illustrative example with reference to FIG. 14, this may entail controlling the actuator 392 to move a carrier 376 and associated holder 378 from the primed position to a launching position via movement of the grabber 386.

The process at 1090 includes providing information associated with the delivery. For example, this may entail continuing to track players at least until an expected target delivery time (e.g., as determined at 1040). In some examples, the operation at 1090 includes providing information to a database for later review by players and/or coaches.

The process at 1095 includes controlling the launcher to prepare for subsequent launch. For example, with reference to FIG. 14, this may entail operating the actuator 392 to move a carrier 376 back into a primed position and/or operating the rotator 393 to rotate the hub 374 to bring another carrier 376 and/or holder 378 into the primed position. In some aspects, the operation at 1095 may be performed in conjunction with a repetition of other operations (e.g., 1025-1090) of the process 1000. For example, the process 1000 may entail iteratively operating to determine different target locations along a route that a player is running and operating to fire successive balls to the player at different locations along that route.

Other variations are within the spirit of the present disclosure. Thus, while the disclosed techniques are susceptible to various modifications and alternative constructions, certain illustrated embodiments thereof are shown in the drawings and have been described above in detail. It should be understood, however, that there is no intention to limit the disclosure to the specific form or forms disclosed, but on the contrary, the intention is to cover all modifications, alternative constructions and equivalents falling within the spirit and scope of the disclosure, as defined in the appended claims.

The use of the terms "a" and "an" and "the" and similar referents in the context of describing the disclosed embodiments (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the disclosure and does not pose a limitation on the scope of the disclosure unless otherwise claimed. No language in the specification should be construed as indicating any non-claimed element as essential to the practice of the disclosure.

Disjunctive language such as the phrase "at least one of X, Y, or Z," unless specifically stated otherwise, is intended to be understood within the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

Preferred embodiments of this disclosure are described herein, including the best mode known to the inventors for carrying out the disclosure. Variations of those preferred embodiments may become apparent to those of ordinary skill in the art upon reading the foregoing description. The inventors expect skilled artisans to employ such variations as appropriate and the inventors intend for the disclosure to be practiced otherwise than as specifically described herein. Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

All references, including publications, patent applications and patents, cited herein or in any contemporaneously filed Information Disclosure Statements are hereby incorporated by reference to the same extent as if each reference were individually and specifically indicated to be incorporated by reference and were set forth in its entirety herein.

What is claimed is:

1. A sports projectile delivery system, comprising:

a base;

a launcher supported by the base and comprising components for imparting motion to a sports projectile for launching the sports projectile from the launcher;

an aiming system comprising components for changing an orientation of the launcher relative to the base;

a reference anchor; and a controller comprising a processor and a non-transitory computer-readable medium comprising processor-executable instructions to cause the processor to:

receive an anchor location corresponding to a location of the anchor relative to a field;

receive an anchor launcher correlation corresponding to a position of the launcher relative to the anchor; and determine a launcher field location corresponding to a location of the launcher relative to the field based at least in part on the anchor location and the anchor launcher correlation;

determine a target location for the sports projectile;

determine a target orientation of the launcher for delivering the sports projectile to the target location via the launcher, wherein the target orientation of the launcher is determined based at least in part on the launcher field location and the target location for the sports projectile; and control the aiming system components to move the launcher to the target orientation.

2. A sports projectile delivery system, comprising:

a base;

a launcher supported by the base and comprising components for imparting motion to a sports projectile for launching the sports projectile from the launcher;

an aiming system comprising components for changing an orientation of the launcher relative to the base;

a player tag, and a controller comprising a processor and a non-transitory computer-readable medium comprising processor-executable instructions to cause the processor to:

receive a player position corresponding to a location of the player tag relative to the launcher or a field associated with the launcher;

determine a target location for the sports projectile, wherein the target location for the sports projectile is determined based at least in part on the player position received;

determine a target orientation of the launcher for delivering the sports projectile to the target location via the launcher; and control the aiming system components to move the launcher to the target orientation.

3. The system of claim 2, further comprising a database, wherein the processor-executable instructions further cause the processor to access the database to at least one of:

retrieve, from the database, information corresponding to a player to affect a target location for the sports projectile determined; or update, in the database, information corresponding to a player based at least in part on information gathered about the player through a player tag associated with the player.

4. The system of claim 2, wherein the processor-executable instructions further cause the processor to:

receive a firing command through a user interface; and control the launcher to launch the sports projectile at a firing time in response to the firing command received through the user interface.

5. The system of claim 2, wherein the aiming system comprises:

a yaw-positioning motor operable to change a position of the launcher relative to the base and about a yaw axis; and a pitch-positioning motor operable to adjust a position of the launcher relative to the base and about a pitch axis.

6. The system of claim 5, further comprising a feeder comprising:

a holder shaped to hold the sports projectile; and an actuator arranged for selectively moving the holder from a primed position to a launching position from which the components of the launcher for imparting motion act on the sports projectile from the holder and impart motion to the sports projectile for launching the sports projectile from the launcher.

7. The system of claim 6, wherein the holder is shaped to hold an American football, wherein the American football is the sports projectile.

8. The system of claim 6, wherein the holder is shaped to hold a soccer ball, wherein the soccer ball is the sports projectile.

9. The system of claim 6, wherein the holder comprises a first holder and the sports projectile comprises a first sports projectile, and wherein the feeder further comprises a carrier configured to receive the first holder and to be moved by the actuator, wherein the carrier is configured to releasably couple the first holder so that the first holder is releasable from the carrier to facilitate interchanging of the first holder with a second holder shaped to hold a second sports projectile that differs in at least one of size or type from the first sports projectile that the first holder is shaped to hold.

10. The system of claim 6, wherein the feeder further comprises a plurality of holders each shaped to hold a respective sports projectile and each selectively movable by the actuator to move from the primed position to the launching position.

11. The system of claim 10, wherein the feeder further comprises a rotatable hub arranged for supporting a plurality of carriers and rotatable to switch which of the plurality of carriers is in the primed position.

12. The system of claim 11, wherein each carrier comprises a first engaging feature;

wherein the feeder further comprises a grabber coupled with the actuator and comprising a second engaging feature for respectively engaging the first engaging feature of whichever carrier is in the primed position to facilitate moving that carrier between the primed position and the launching position in response to movement of the actuator;

wherein the first engaging feature and the second engaging feature collectively comprise a slot and a projection sized to fit into and engage the slot such that the first engaging feature comprises one of the slot or the projection and the second engaging feature comprises the other of the slot or the projection; and wherein the carriers are arranged about the hub such that rotation of the rotatable hub moves the second engagement feature of the grabber out of engagement with the first engagement feature of one of the carriers and into engagement with the first engagement feature of another of the carriers.

13. The system of claim 5, wherein the base comprises a frame that at least partially bounds an interior volume, and wherein the system further comprises:

a tower supporting the launcher relative to the base and supporting the yaw-positioning motor and the pitch-positioning motor; and a pivot joint coupling the tower with the base so that the tower is pivotable about the pivot joint between a stowed position at least partially within the interior volume of the frame and a deployed position at least partially out of the interior volume of the frame.

14. The system of claim 5, further comprising a user interface communicatively coupled with the aiming system such that the yaw-positioning motor and the pitch-positioning motor control the orientation of the launcher relative to the base in response to input from the user interface.

15. The system of claim 14, wherein the user interface comprises a joystick such that the yaw-positioning motor and the pitch-positioning motor control the orientation of the launcher relative to the base in response to input from the joystick.

16. The system of claim 14, wherein the user interface comprises an input device configured to receive an indication of a target location relative to at least one of the base, the launcher, or a sports field, wherein the yaw-positioning motor and the pitch-positioning motor control the orientation of the launcher relative to the base in response to the indication of the target location received via the input device.

17. A method comprising, under the control of one or more computer systems configured with executable instructions:

determining a target location relative to a launcher comprising components for imparting motion to a sports projectile for launching the sports projectile from the launcher;

determining a target orientation of the launcher for delivering the sports projectile to the target location via the launcher;

controlling components of an aiming system for changing an orientation of the launcher to move the launcher to the target orientation;

receiving player location information relative to the launcher or a field associated with the launcher;

determining a target delivery time at which the projectile is to be delivered to the target location, wherein the target delivery time is determined based at least in part on the player location information received; and controlling the launcher to launch the sports projectile at a firing time based at least in part on the target delivery time.

18. The method of claim 17, further comprising:

receiving route information about a route to be run by a player, wherein the target delivery time is determined based at least in part on the route information received.

19. A sports projectile delivery system, comprising:

a base;

a launcher supported by the base and comprising components for imparting motion to a sports projectile for launching the sports projectile from the launcher;

an aiming system comprising components for changing an orientation of the launcher relative to the base; and a controller comprising a processor and a non-transitory computer-readable medium comprising processor-executable instructions to cause the processor to:

access player attribute information corresponding to a player height or other physical attribute of a player;

determine a target location for the sports projectile based at least in part on the player attribute information;

determine a target orientation of the launcher for delivering the sports projectile to the target location via the launcher; and control the aiming system components to move the launcher to the target orientation.

20. The system of claim 19, further comprising a database, wherein the processor-executable instructions further cause the processor to at least one of:

access the player attribute information from the database; or update, in the database, information corresponding to the player based at least in part on information gathered about the player through a player tag associated with the player.

* * * * *